US010564591B2

(12) United States Patent
Toba et al.

(10) Patent No.: US 10,564,591 B2
(45) Date of Patent: Feb. 18, 2020

(54) PHOTOSENSITIVE MEMBER UNIT AND ELECTROPHOTOGRAPHIC IMAGE FORMING APPARATUS

(71) Applicant: CANON KABUSHIKI KAISHA, Tokyo (JP)

(72) Inventors: Shinjiro Toba, Yokohama (JP); Masanari Morioka, Yokohama (JP); Hiroshi Takarada, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/797,148

(22) Filed: Oct. 30, 2017

(65) Prior Publication Data

US 2018/0129157 A1 May 10, 2018

(30) Foreign Application Priority Data

Nov. 7, 2016 (JP) ..... 2016-216985

(51) Int. Cl.
*G03G 15/00* (2006.01)
*G03G 21/16* (2006.01)

(52) U.S. Cl.
CPC ..... *G03G 21/1619* (2013.01); *G03G 21/1671* (2013.01); *G03G 21/1676* (2013.01);
(Continued)

(58) Field of Classification Search
CPC ..... G03G 15/757; G03G 2221/1684; G03G 21/1647; G03G 21/1671
(Continued)

(56) References Cited

U.S. PATENT DOCUMENTS 6,381,428 B1 4/2002 Yamamoto et al.
7,116,925 B2 10/2006 Yamaguchi
(Continued)

FOREIGN PATENT DOCUMENTS

EP 2138908 A1 12/2009
JP S62299977 A 12/1987
(Continued)

OTHER PUBLICATIONS

Office Action issued in Japanese Appln. No. 2017-193376 dated Aug. 21, 2018.

*Primary Examiner* — Walter L Lindsay, Jr.
*Assistant Examiner* — Frederick Wenderoth
(74) *Attorney, Agent, or Firm* — Rossi, Kimms & McDowell LLP

(57) ABSTRACT

A photosensitive member unit includes photosensitive drums and a frame including positioning portions. One and the other end shaft portions of the photosensitive drums are movable between first positions in which the above-mentioned one and the other end shaft portions are positioned by the positioning portions and second positions in which the above-mentioned one end of the other end shaft portions are not positioned by said positioning portions. The photosensitive member unit includes a plurality of mounting portions which are provided in the frame and to which developing units including developing members capable of supplying toner to the photosensitive drums are mountable, and from which the developing units are dismountable without dismounting the photosensitive drums from the frame, in a state that the above-mentioned one and the other end shaft portions are positioned by the positioning portions.

13 Claims, 15 Drawing Sheets

(52) U.S. Cl.
CPC ..... *G03G 2221/1684* (2013.01); *G03G 2221/1869* (2013.01)

(58) Field of Classification Search
USPC ..... 399/117
See application file for complete search history.

(56) References Cited

U.S. PATENT DOCUMENTS

| | | | | |
|---|---|---|---|---|
| 7,650,098 | B2 | 1/2010 | Murayama | |
| 7,899,360 | B2 | 3/2011 | Kondo et al. | |
| 2006/0257163 | A1* | 11/2006 | Sato | G03G 21/1821 399/111 |
| 2008/0138115 | A1* | 6/2008 | Chadani | G03G 21/186 399/167 |
| 2009/0324275 | A1 | 12/2009 | Okabe | |
| 2010/0067947 | A1 | 3/2010 | Yuzawa | |
| 2010/0080615 | A1 | 4/2010 | Kikuchi | |
| 2013/0156463 | A1* | 6/2013 | Jung | G03G 21/1633 399/110 |
| 2015/0248100 | A1* | 9/2015 | Hayakawa | G03G 15/757 399/167 |
| 2016/0231700 | A1 | 8/2016 | Sato | |

FOREIGN PATENT DOCUMENTS

| | | | |
|---|---|---|---|
| JP | H0462574 | A | 2/1992 |
| JP | 2000321843 | A | 11/2000 |
| JP | 2001134042 | A | 5/2001 |
| JP | 2001255777 | A | 9/2001 |
| JP | 2003316105 | A | 11/2003 |
| JP | 2007140041 | A | 6/2007 |
| JP | 2007322733 | A | 12/2007 |
| JP | 2009109645 | A | 5/2009 |
| JP | 2010008724 | A | 1/2010 |
| JP | 2010072307 | A | 4/2010 |
| JP | 2010102304 | A | 5/2010 |
| JP | 2012189896 | A | 10/2012 |
| JP | 2016145897 | A | 8/2016 |

* cited by examiner

PHOTOSENSITIVE MEMBER UNIT AND ELECTROPHOTOGRAPHIC IMAGE FORMING APPARATUS

FIELD OF THE INVENTION AND RELATED ART

The present invention relates to a photosensitive member unit and an electrophotographic image forming apparatus.

Conventionally, in an image forming apparatus using an electrophotographic image forming process, a process cartridge type in which a photosensitive drum and a developing unit including a developing roller actable on the photosensitive drum and accommodating a developer (toner) used for image formation are integrally assembled into a unit (cartridge). A developing cartridge type constituted only by the developing unit which is a separate member from the photosensitive drum has also been known. According to these cartridge types, maintenance of the apparatus can be performed by a user himself (herself) without relying on a service person. For that reason, these cartridge types have been widely used in the electrophotographic image forming apparatus.

Further, a technique such that a photosensitive member unit in which a plurality of photosensitive drums are integrally assembled is constituted so that an exchanging operation can be performed by pulling out from an inside of an apparatus main assembly to a predetermined position has also been known. According to this technique, the user can easily carry out exchange of the photosensitive member unit.

In such a prior art, there is a need to assemble respective parts (components) constituting the photosensitive member unit with high accuracy, and in addition, the number of parts used until positions of the photosensitive drums relative to the image forming apparatus main assembly are determined is large.

For that reason, in order to accurately position the photosensitive drums relative to the image forming apparatus main assembly, in some cases, countermeasures such that accuracy of the parts was enhanced and that adjusting assembling was carried out during manufacturing were taken (Japanese Laid-Open Patent Application 2001-134042, page 6, paragraph [0050] and the like).

SUMMARY OF THE INVENTION

A principal object of the present invention is to enable positioning of a photosensitive member unit with high accuracy.

According to an aspect of the present invention, there is provided a photosensitive member unit detachably mountable to a main assembly of an electrophotographic image forming apparatus, the photosensitive member unit comprising: a plurality of photosensitive drums having respective rotational axes and each including one and the other end shaft portions coaxial with the respective rotational axes; a frame supporting the plurality of photosensitive drums and including a plurality of positioning portions configured to position the above-mentioned one and the other shaft portions, wherein the above-mentioned one and the other end shaft portions are movable between first positions in which the above-mentioned one and the other end shaft portions are positioned by the positioning portions and second positions in which the above-mentioned one end of the other end shaft portions are not positioned by the positioning portions; and a plurality of mounting portions which are provided in said frame and to which developing units including developing members capable of supplying toner to the photosensitive drums are mountable, and from which the developing units are dismountable without dismounting the photosensitive drums from the frame, in a state that the above-mentioned one and the other end shaft portions are positioned by the above-mentioned positioning portions.

According to another aspect of the present invention, there is provided an electrophotographic image forming apparatus comprising: a main assembly; a photosensitive member unit detachably mountable to the main assembly of the electrophotographic image forming apparatus in a predetermined image forming position, wherein the photosensitive member unit includes a plurality of photosensitive drums and a frame supporting the photosensitive drums and including mounting portions; and a plurality of developing units including developing members configured to supply toners to the photosensitive drums and including toner accommodating portions accommodating the toners to be supplied to the photosensitive drums, wherein the developing units are dismountable without dismounting the photosensitive drums from the photosensitive member unit, wherein the photosensitive drums having respective rotational axes and each including one and the other end shaft portions coaxial with the respective rotational axes, wherein the frame includes a plurality of first positioning portions configured to position the above-mentioned one and the other end shaft portions of the photosensitive drums, wherein the main assembly includes a plurality of second positioning portions configured to position the above-mentioned one and the other end shaft portions of the photosensitive drums, wherein the above-mentioned one and the other end shaft portions are in first positions in which the above-mentioned one and the other end shaft portions are positioned by the first positioning portions so that the photosensitive member unit is not in the image forming portion, and wherein the above-mentioned one and the other end shaft portions of the photosensitive drums are in second positions in which the above-mentioned one and the other end portions are positioned by the second positioning portions and are not positioned by the first positioning portions so that the photosensitive member unit is in the image forming portion.

Further features of the present invention will become apparent from the following description of exemplary embodiments with reference to the attached drawings.

BRIEF DESCRIPTION OF THE DRAWINGS

Part (a) to (e) of FIG. 1 are schematic views for illustrating an operation process in which a drum unit-side drum is positioned relative to an apparatus main assembly-side drum positioning member.

Figure 9:
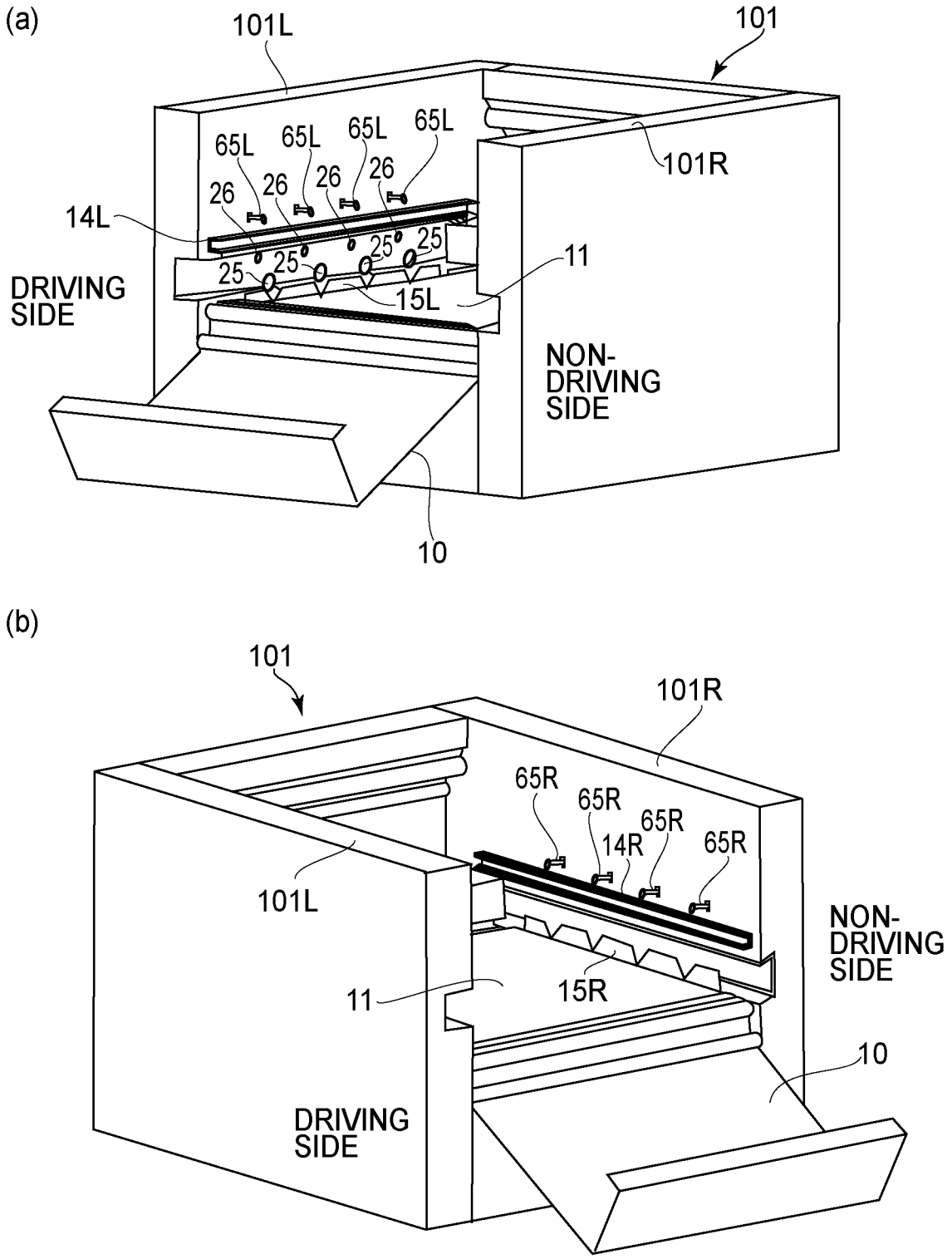

Parts (a) and (b) of FIG. 9 are schematic views showing a structure of a drum unit mounting portion inside an apparatus main assembly.

Figure 10:
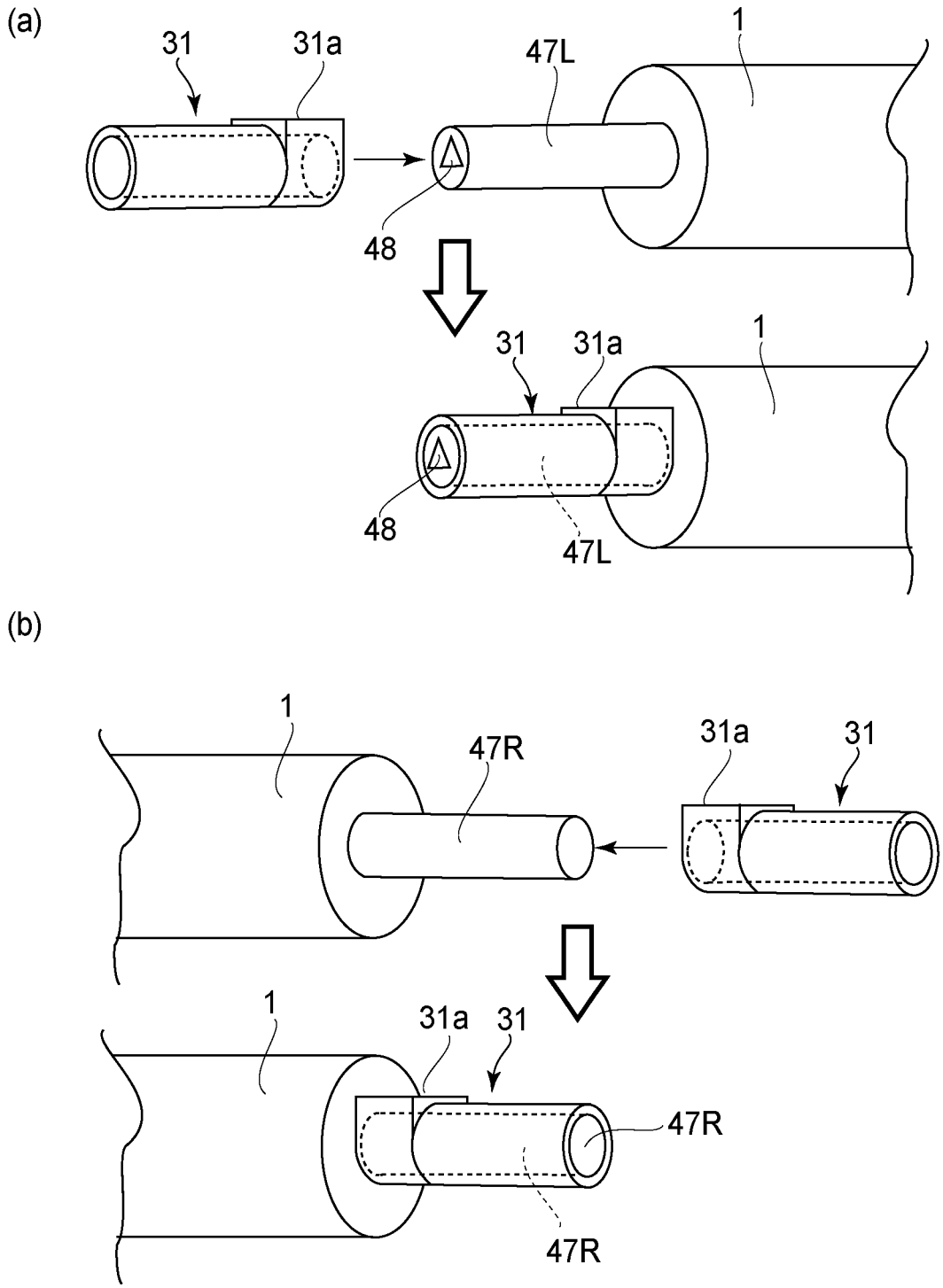

Parts (a) and (b) of FIG. 10 are schematic views showing shaft portions and bearing members externally fitted thereto in the driving side and the non-driving side, respectively, of a drum.

Figure 11:
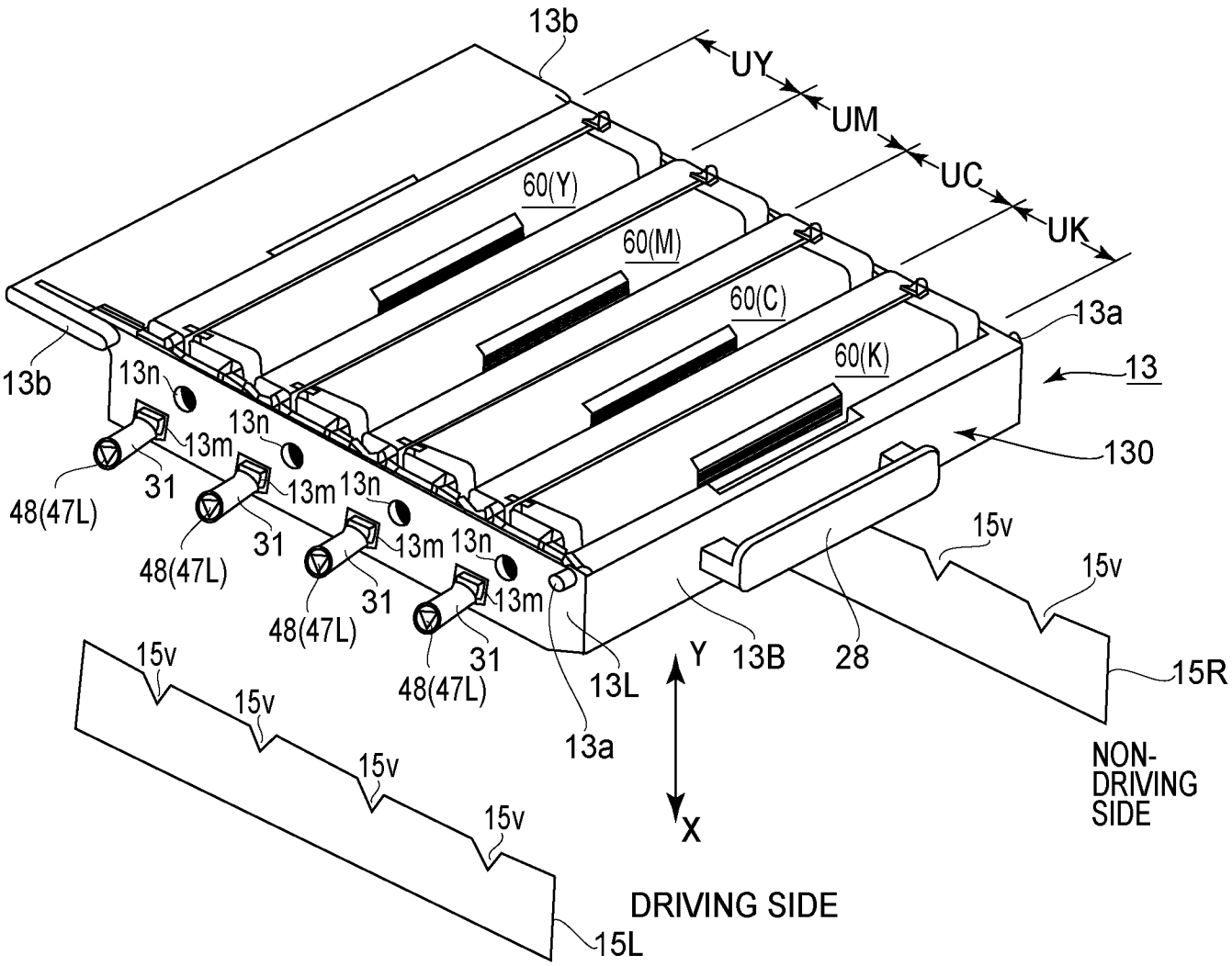

FIG. 11 is a schematic perspective view showing a positional relationship between the drum unit and apparatus main assembly-side drum positioning members as seen from the driving side.

Figure 12:
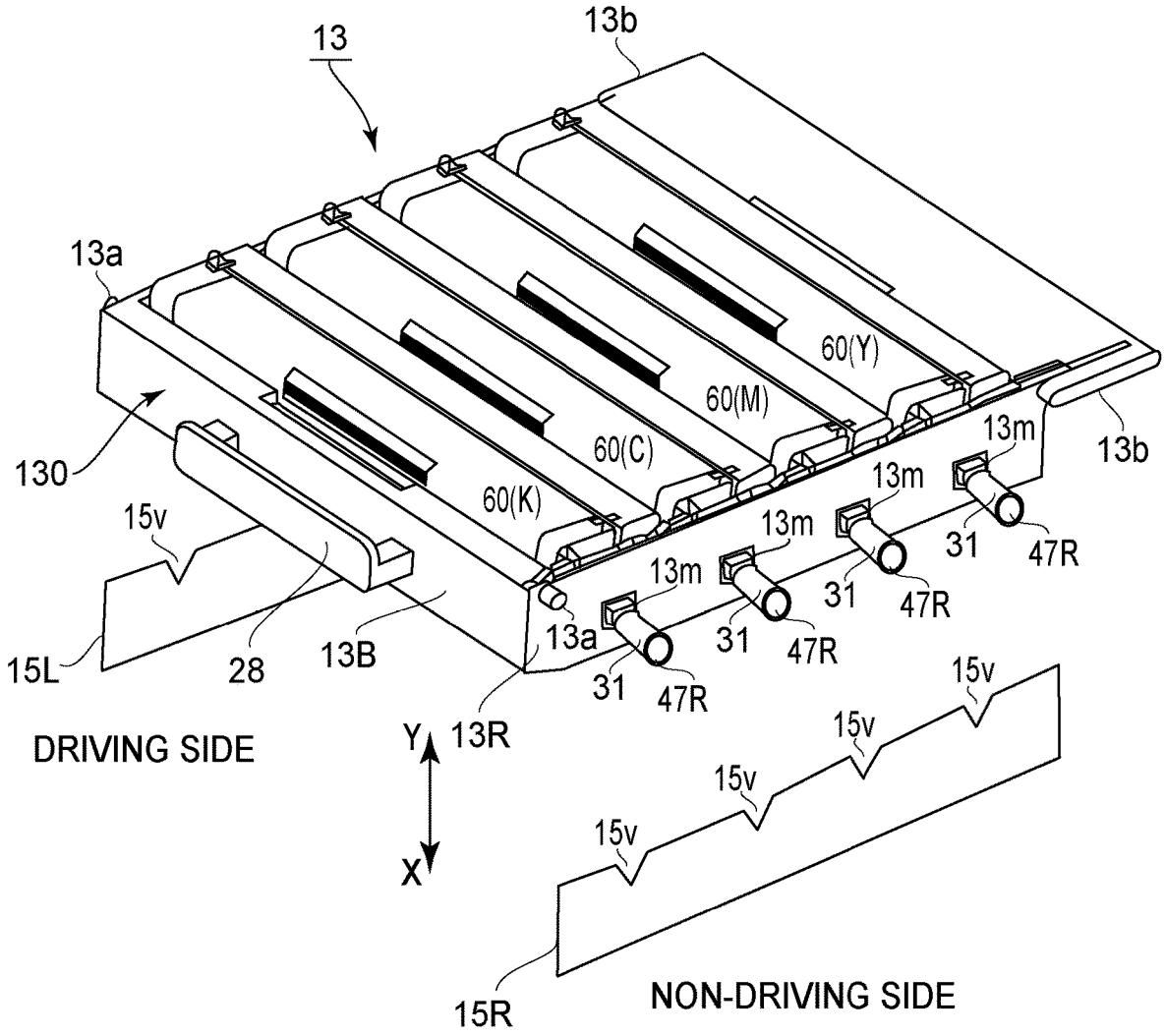

FIG. 12 is a schematic perspective view showing the positional relationship, shown in FIG. 11, as seen from the non-driving side.

Figure 13:
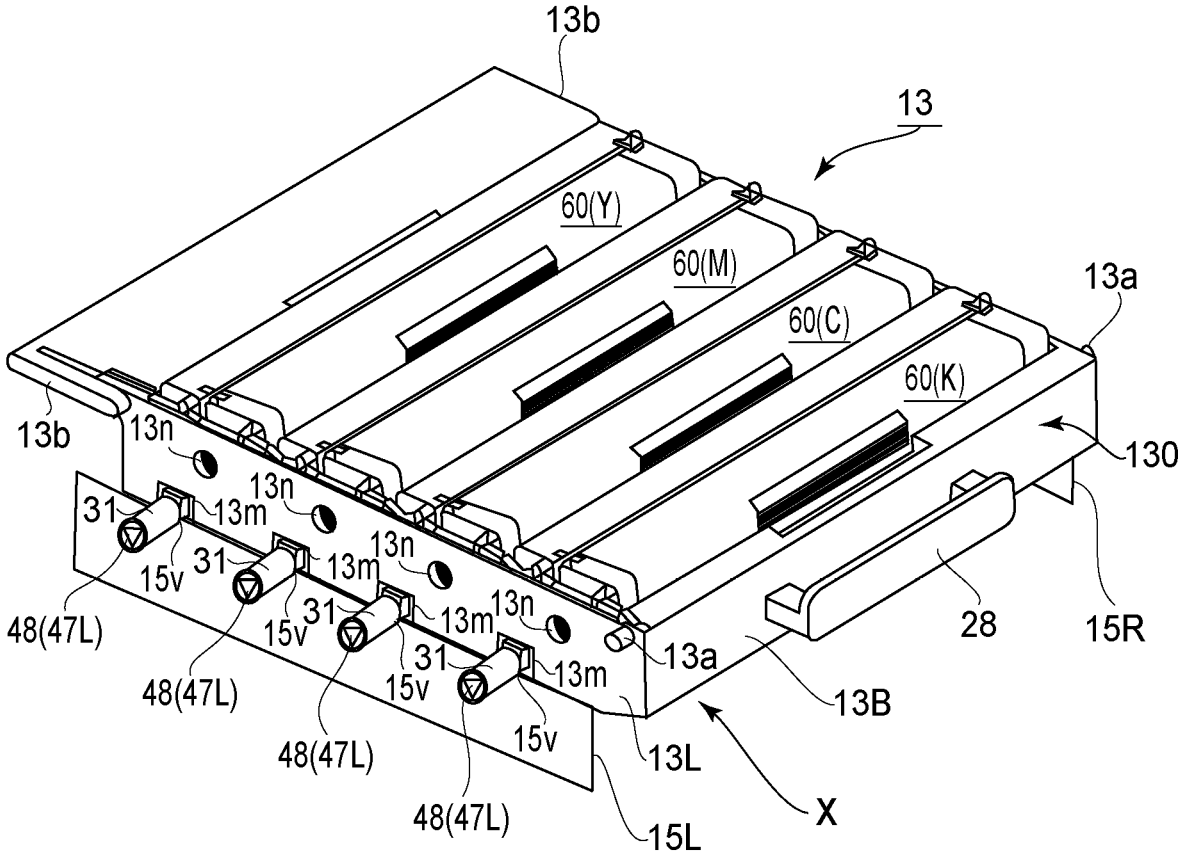

FIG. 13 is a schematic perspective view showing a state in which respective drums of the drum unit are positioned and fixed to the apparatus main assembly-side drum positioning members in a predetermined manner.

Figure 14:
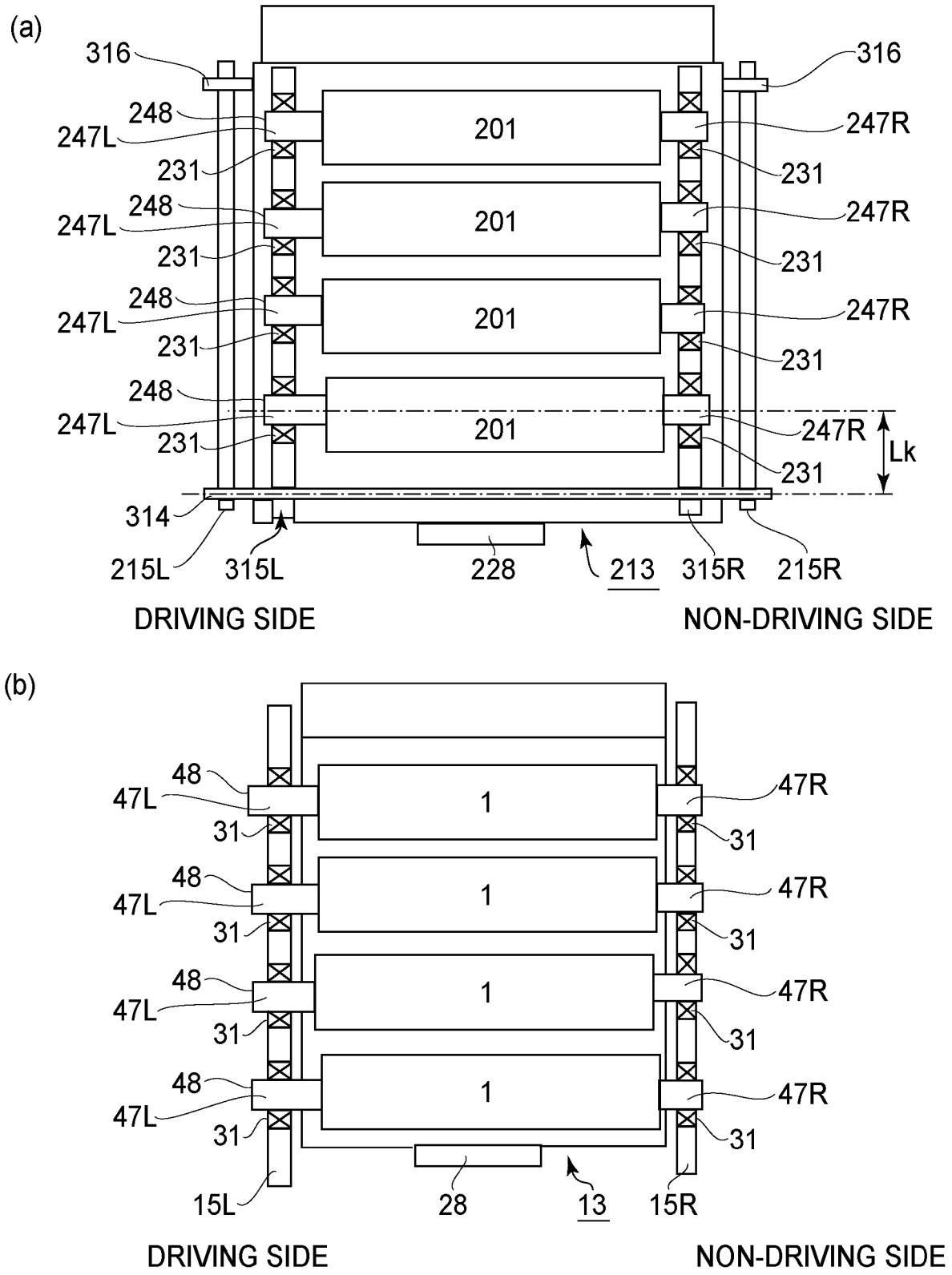

Parts (a) of FIG. 14 is a schematic view of a drum unit in a comparison example, and part (b) of FIG. 14 is a schematic view of the drum unit in the embodiment.

DESCRIPTION OF EMBODIMENTS

[Embodiment 1]

<General Structure of Image Forming Apparatus>

Figure 2:
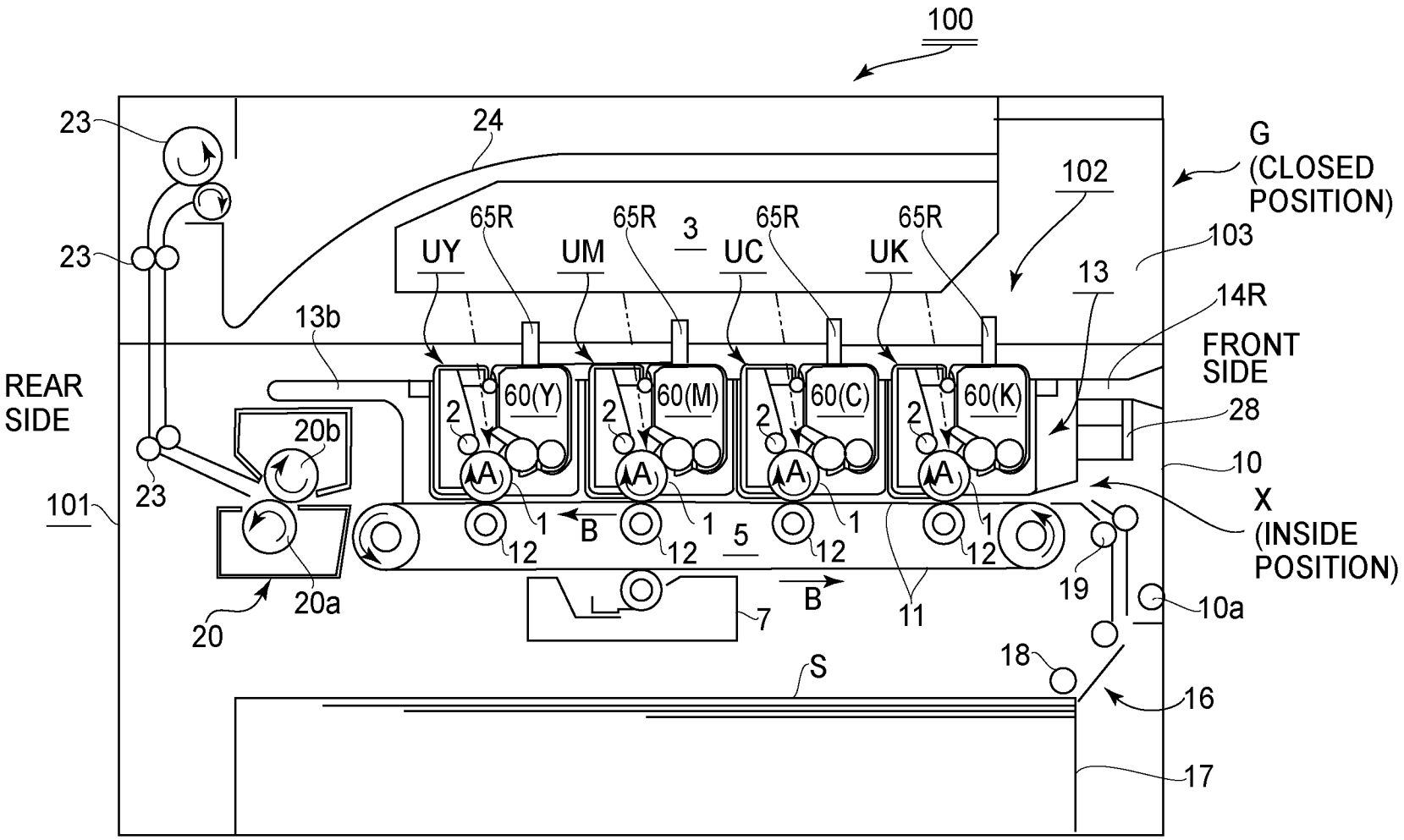
FIG. 2 is a schematic longitudinal left side view of an image forming apparatus in an embodiment.

FIG. 2 is a schematic longitudinal left side view of an electrophotographic image forming apparatus (hereinafter, referred to as an image forming apparatus or an apparatus) 100 in this embodiment. The apparatus 100 is a four-color based full-color laser printer of a tandem type using a plurality of electrophotographic photosensitive drums (image bearing members, hereinafter referred to as photosensitive drums or drums), i.e., four drums 1 in this embodiment.

Here, as regards this apparatus 100, a front surface refers to a surface in a side where a front door (openable member) 10 is provided, a rear (back) surface is a surface opposite from the front surface, and left and right is those when the apparatus 100 is seen from the front surface (side). In the apparatus 100 in this embodiment, a left(-hand) side is a driving side, and a right(-hand) side is a non-driving side. A frontward (forward) direction is a direction from a rear surface side toward a front surface side, and a rearward (backward) direction from the front surface side toward the rear surface side. Above and below are those with respect to a direction of gravitation. An upward direction is a direction from below toward above, and a downward direction is a direction from above toward below.

An image forming apparatus main assembly (hereinafter referred to as an apparatus main assembly or a main assembly) 101 means a main assembly from which of various members (parts) constituting the apparatus 100, at least a drum unit 13 and members (parts) fixed to or detachably mountable to the drum unit 13, which will be described later, are removed.

An image forming portion 102 provided inside the apparatus main assembly 101 includes first to fourth (four) image forming stations UK, UC, UM and UY arranged from the front surface side toward the rear surface side of the apparatus 100 in a substantially horizontal direction (relative to the apparatus main assembly).

The respective image forming stations UK, UC, UM and UY are similar electrophotographic process mechanisms, and colors of toners which are developers used are different from each other. In this embodiment, the color of the toner used in the first image forming station UK is black (K), and the color of the toner used in the second image forming station UK is cyan (C). The color of the toner used in the third image forming station UM is magenta (M), and the color of the toner used in the fourth image forming station UY is, yellow (Y).

Each of the image forming stations UK, UC, UM and UY includes the drum 1 rotationally driven at a predetermined peripheral speed in the clockwise direction of an arrow A by a driving means (not shown), and a charging means 2 and a developing means 60 which are used as a process means actable on the drum 1.

The drum 1 is, for example, prepared by applying an organic photoconductor (OPC) layer onto an outer peripheral surface of an aluminum cylinder. The charging means 2 has a function of electrically charging a surface of the drum 1 uniformly. In this embodiment, a charging means of a contact charging type is used. Specifically, the charging means 2 is an electroconductive roller (charging roller) formed in a roller shape, and this roller is contacted to the surface of the drum 1. By applying a charging bias voltage to this roller, the surface of the drum 1 is uniformly charged. The developing means 60 has a function of developing, with the toner, an electrostatic latent image formed on the surface of the drum 60.

Above the image forming stations UK, UC, UM and UY, a laser scanner unit hereinafter referred to as a scanner) 3 is provided.

In the scanner 3, image light (laser beam) corresponding to an image signal is emitted from a laser diode (not shown), so that the charged surface of the drum 1 is exposed to the light. As a result, the electrostatic latent image depending on an image signal is formed on the surface of the drum 1.

Below the image forming stations UK, UC, UM and UY, an electrostatic transfer means 5 is provided. In this embodiment, the electrostatic transfer means 5 includes an electrostatic transfer belt (hereinafter referred to as a belt) 11 rotationally driven at a peripheral speed corresponding to the rotational peripheral speed of the drums 1 in the counterclockwise direction of an arrow B in contact with the drums 1 of the image forming stations UK, UC, UM and UY.

The belt 11 has a function of transferring toner images, onto a sheet material S, from the drums 1 by successively feeding the sheet material S as a recording material (medium) to transfer positions which are contact portions of the belt 11 with the respective drums 1. As specific examples of the sheet material S, it is possible to cite paper, an OHP sheet, and a cloth. Inside the belt 11, transfer rollers 12 are provided in positions opposing the drums 1. From these transfer rollers 12, positive electric charges are applied to the sheet material S through the belt 11. As a result, the toner images are transferred from the drums 1 onto the sheet material S. In a side under the belt 11, a cleaning means 7 for removing residual toner deposited on the belt 1 is provided.

Below the electrostatic transfer means 5, a (sheet) feeding portion 16 having a function of feeding the sheet material S to the image forming stations UK, UC, UM and UY. The feeding portion 16 is provided with a feeding cassette 17 accommodating a plurality of sheet materials S. During image formation, a feeding roller 18 and a registration roller pair 19 rotate depending on an image forming operation. The sheet materials S in the cassette 17 are fed one by one by the feeding roller 18, and the fed sheet material S is sent by the registration roller pair 19 to the belt 11 in synchronism with the rotation of the belt 11 and the toner images formed on the drums 1.

Then, the sheet material S is successively conveyed to the transfer positions of the image forming stations UK, UC, UM and UY while being carried on the belt 11. As a result, the toner images of black (K), cyan (C), magenta (M) and yellow (Y) are successively transferred from the drums 1 of the image forming stations UK, UC, UM and UY onto the sheet material S in a predetermined superposition manner, so that a four-color-based full-color toner image is formed. The sheet material S is introduced from the belt 11 to a fixing portion 20.

The fixing portion 20 has a function of fixing the toner images, of the plurality of colors, superposedly transferred on the sheet material S. The fixing portion 20 is constituted by a rotatable heating roller 21*b* and a pressing roller 21*a* press-contacted to the heating roller 21*b*. The sheet material S is nipped and fed by the heating roller 21*b* and the pressing roller 21*a*, and during the feeding, heat and pressure are applied to the sheet material S. As a result, the toner images of the plurality of the colors are fixed on the surface of the sheet material S. The sheet material S on which the color image is fixed by the fixing portion 20 is discharged onto an external discharge portion (discharge tray) 24 of the apparatus 100 by a discharging roller pair 23.

<Outline of Drum Unit>

In the apparatus 100 in this embodiment, an entirety of the four drums 1 and the charging rollers, corresponding to the drums 1, of the first to fourth image forming stations UK, UC, UM and UY is assembled into a unit which is a drum unit 13 exchangeable relative to the apparatus main assembly 101. That is, the drum unit 13 is a photosensitive member unit (drum cartridge) 13 detachably mountable to the apparatus main assembly 100.

The four developing means 60 in the first to fourth image forming stations UK, UC, UM and UY are formed as developing cartridges 60 exchangeable relative to the apparatus main assembly 101. That is, each of the four developing means 60 is formed as the developing cartridge 60 detachably mountable to the apparatus main assembly 101. The drum unit 13 also performs a function as a supporting member detachably supporting the four developing cartridges 60.

Figure 3A:
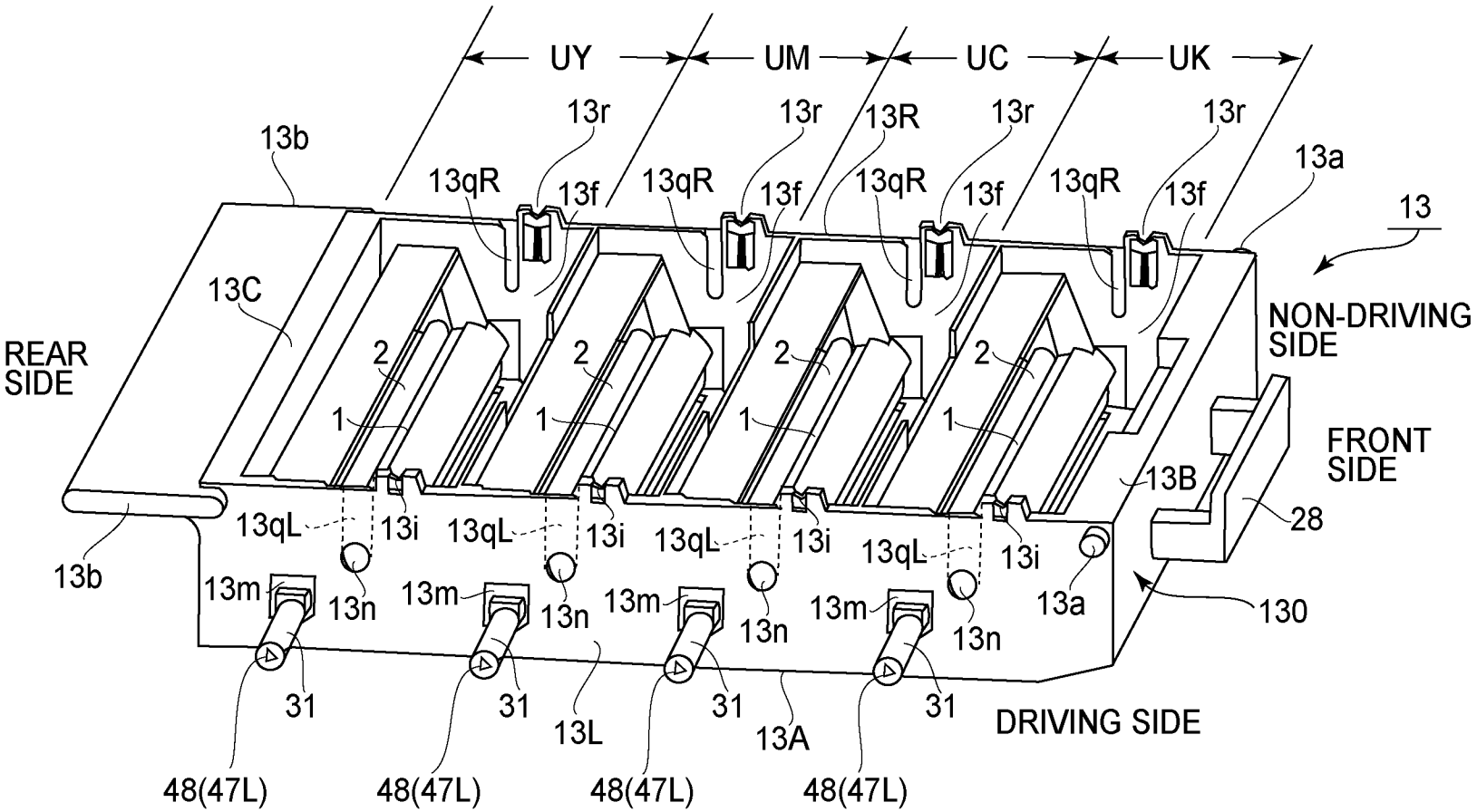
FIG. 3A is a schematic perspective view of a drum unit as seen from a driving side.
Figure 3B:
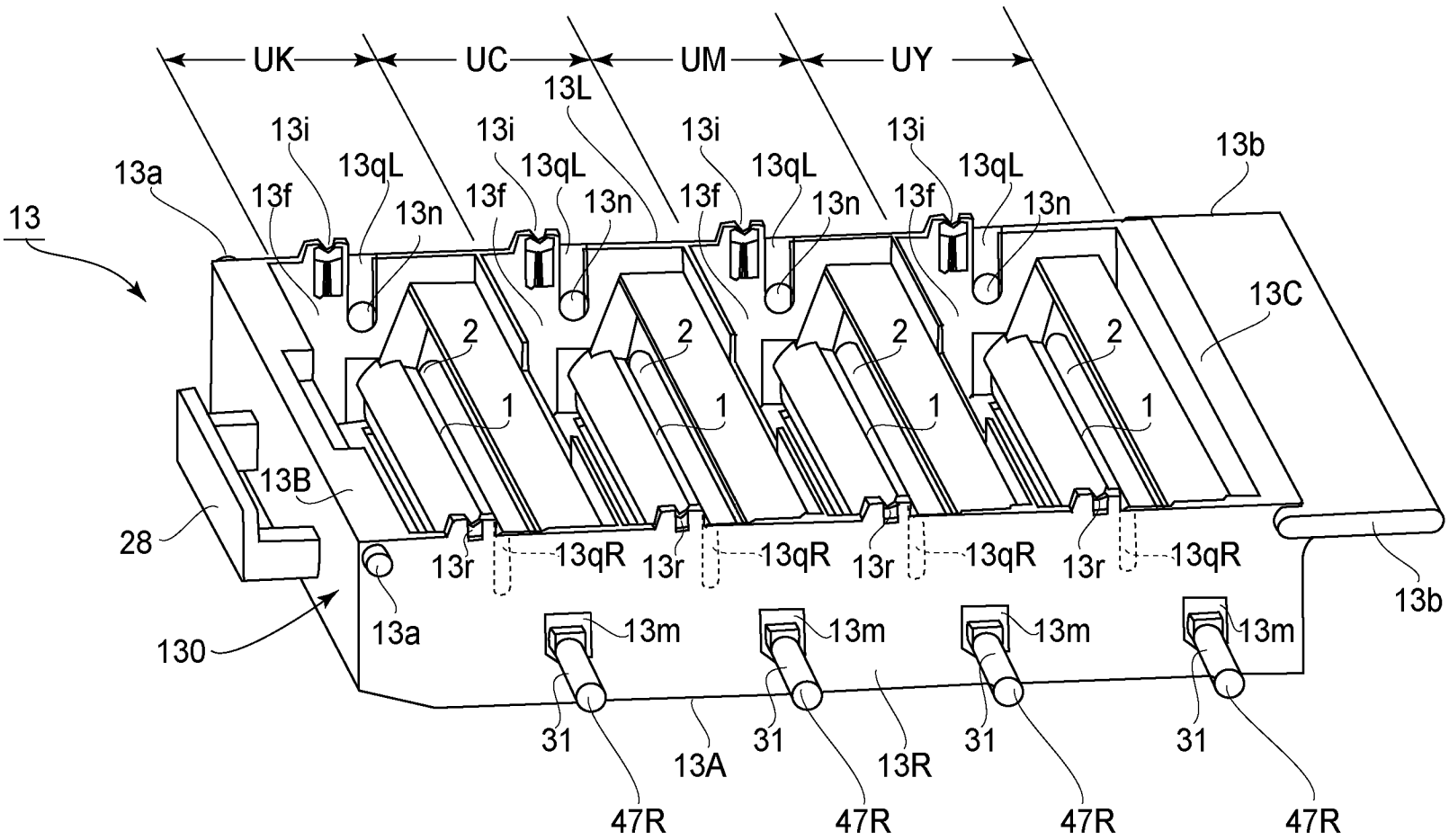
FIG. 3B is a schematic perspective view of the drum unit as seen from a non-driving side.
Figure 4:
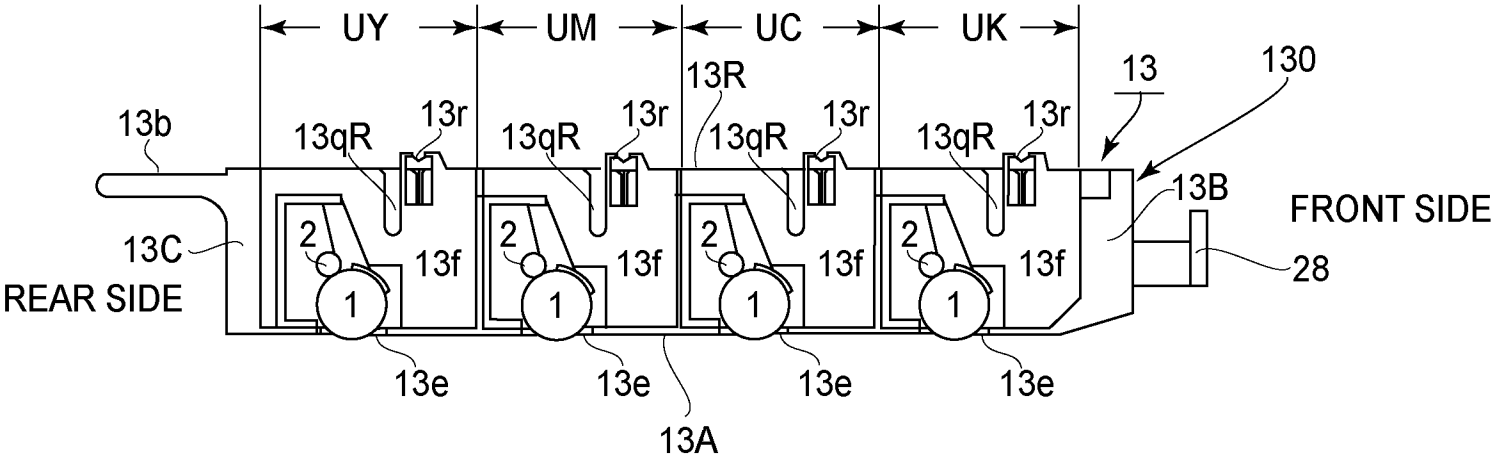
FIG. 4 is a schematic longitudinal left side view of the drum unit.
Figure 5:
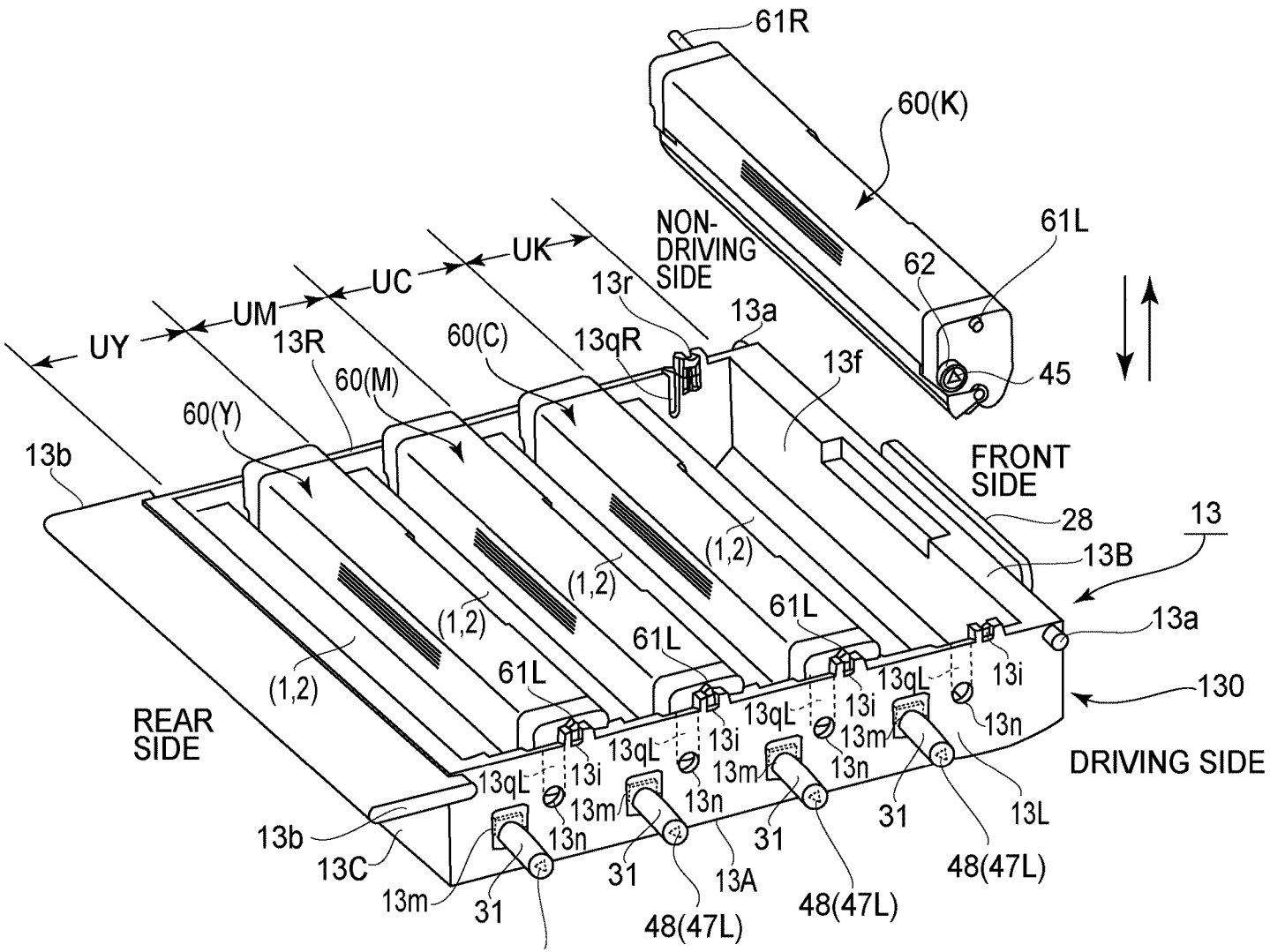
FIG. 5 is a schematic perspective view of the drum unit from which a developing cartridge of a first image forming station is demounted.

FIG. 3A is a schematic perspective view of the drum unit 13 as seen from the driving side, and FIG. 3B is a schematic perspective view of the drum unit 13 as seen from the non-driving side. FIG. 4 is a schematic longitudinal left side view of the drum unit 13. In FIGS. 3A, 3B and 4, the developing cartridges 60 of the first to fourth image forming stations UK, UC, UM and UY have already been removed from the drum unit 13. FIG. 5 is a schematic perspective view of the drum unit 13 in a state in which the developing cartridges 60 are mounted in the second to fourth image forming stations UC, UM and UY, and the developing cartridge 60 of the first image forming station UK has already been removed from the first image forming station UK.

The drum unit 13 includes a unit frame (hereinafter referred to as a frame) 130 with which the four drums 1 and the corresponding charging rollers 2 of the first to fourth image forming stations UK, UC, UM and UY are assembled so as not to be dismountable by the user. Further, the frame 130 includes four mounting portions 13*f* to which the developing cartridges 60 of the first to fourth image forming stations UK, UC, UM and UY are detachably mountable. The four developing cartridges 60 are mounted in the four mounting portions 13*f* of the frame 130 without demounting the drums 1 from the frame 130.

The frame 130 is a rectangular parallelopiped (rectangular) box-like member constituted by a bottom plate 13A, a front frame plate 13B, a rear frame plate 13C, a left frame plate 13L and a right frame plate 13R, and is open at an upper surface. At an outer surface of the front frame plate 13B, a grip portion 28 is provided. At each of outer surfaces of the left and right frame plates 13L and 13R, a cylindrical pin shaft 13*a* as a first guiding portion is provided at a front portion with respect to a front-rear direction, and a projected portion 13*b* as a second guiding portion is provided at a rear portion with respect to the front-rear direction. The projected portions 13*b* are extended rearward in the front-rear direction so as to project from the rear frame plate 13C, and are connected with each other at their left and right extended portions.

Inside the frame 130, from the front side toward the rear side, the four drums 1 and the corresponding charging rollers 2 of the first to fourth image forming positions UK, UC, UM and UY are provided and arranged with predetermined intervals. Portions having the predetermined intervals are the mounting portions 13*f* of the developing cartridges 60. The respective drums 1 are disposed in parallel to each other so as to extend in their axial directions which are a left-right direction. Further, shaft portions 47L and 47R in the left side (driving side) and the light side (side non-driving side), respectively, are supportably supported by supporting structures, described later, of the left frame plate 13L and the right frame plate 13R, respectively, through bearing members 31 (FIG. 3A, FIG. 3B).

The bottom plate 13A is provided with elongated openings 13*e* extending in the left-right direction at positions corresponding to lower surfaces of the respective drums 1. Each of the drums 1 is projected and exposed at its lower surface portion to an outside of the bottom plate 13A through the opening 13*e*.

<Developing Cartridge>

Figure 6:
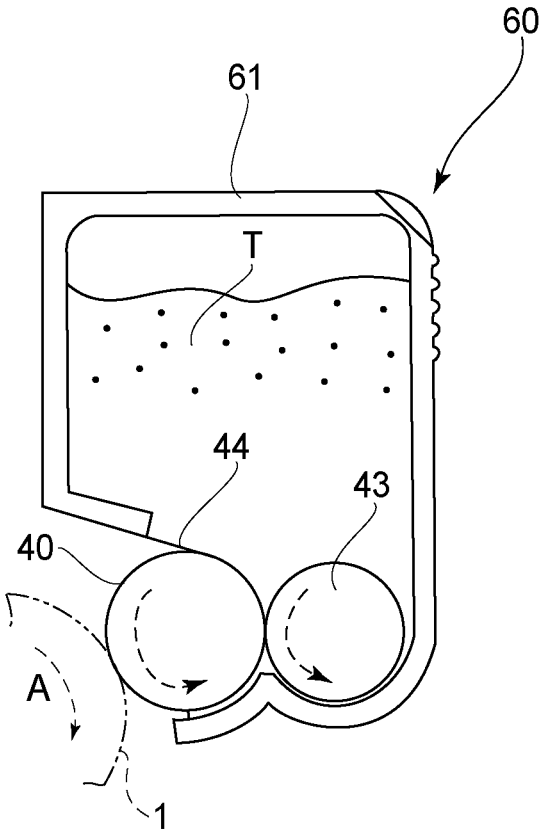
FIG. 6 is a schematic cross-sectional view of the developing cartridge.

FIG. 6 is a schematic cross-sectional view of the developing cartridge 60. The respective developing cartridges 60 in the first to fourth image forming stations UK, UC, UM and UY have similar structures except that the colors of the toners accommodated therein are different from each other. In the developing cartridge 60(K) of the first image forming station UK, toner T of the black (K) is accommodated, and in the developing cartridge 60(C) of the second image forming station UC, toner T of cyan (C) is accommodated. In the developing cartridge 60(M) of the third image forming station UM, toner T of magenta (M) is accommodated, and in the developing cartridge 60(Y) of the fourth image forming station UY, toner T of yellow (Y) is accommodated.

The developing cartridge 60 is constituted by a developing roller 40, a toner supplying roller 43, a developing blade 44 and a toner container (developer accommodating portion) 61 for accommodating the toner T. The toner T in the toner container 61 is sent to the toner supplying roller 43. Then, the toner is applied onto an outer peripheral surface of the developing roller 40 by the toner supplying roller 43 and the developing blade 44 press-contacted to the outer peripheral surface of the developing roller 40.

By applying a developing bias from the apparatus main assembly 101 to the developing roller 40, the toner T is deposited on the latent image formed on the drum 1 and thus the toner image is formed. The developing roller 40 is disposed so as to oppose and contact the drum 1.

<Exchange System of Developing Cartridge and Drum Unit>

(1) With use of the developing cartridges 60 of the respective image forming stations UK, UC, UM and UY, the toners T accommodated in the toner containers 61 are gradually consumed. Then, when the toners T are consumed to the extent that an image having a quality which can be satisfactory to a user (operator) who purchased the developing cartridge 60 cannot be formed, the developing cartridge 60 loses its commercial value as the developing cartridge.

Therefore, for example, a means (not shown) for detecting a remaining toner amount of the individual developing cartridge 60 is provided. Then, in a control circuit portion (not shown), a detected remaining amount value is compared with a preset threshold for prewarning or warning of a lifetime of the developing cartridge 60. Then, as regards the developing cartridge 60 in which the detected remaining amount value is smaller than the threshold, the prewarning or warning of the lifetime of the developing cartridge 60 is displayed at a display portion (not shown). As a result, the user is prompted to prepare a developing cartridge for exchange or to exchange the developing cartridge 60, so that the quality of an output image is maintained.

Also as regards the drum unit 13, with use of the drums 1 of the image forming stations UK, UC, UM and UY in image formation, photosensitive layers are abraded, so that layer thicknesses decrease. Then, when the layer thickness of the photosensitive layer of any of the drums 1 decreases to the extent that the image having the quality satisfactory to the user cannot be formed, the drum unit 13 loses its commercial value as the drum unit.

Therefore, for example, a means (not shown) for detecting the layer thickness of the photosensitive layer of the individual drum 1 is provided. Then, in a control circuit portion (not shown), a detected layer thickness value is compared with a preset threshold for prewarning or warning of a lifetime of the drum 1. Then, when the detected layer thickness value of the photosensitive layer of any of the drums 1 is smaller than the threshold, the prewarning or warning of the lifetime of the drum unit 13 is displayed at a display portion (not shown). As a result, the user is prompted to prepare a drum unit 13 for exchange or to exchange the drum unit 13, so that the quality of an output image is maintained. Further, also in the case where damage such that the quality of the output image is considerably impaired is generated in the photosensitive layer of the drum 1 for some reason, there is a need to exchange the drum unit 13.

In the apparatus 100 of this embodiment, the exchange of the developing cartridges 60 and the drum unit 13 is of the type in which in order to improve usability, the drum unit 13 is slid and moved relative to the apparatus main assembly 101 and is exchanged in a front access manner.

(2) In the apparatus 100 of this embodiment, the front surface of the apparatus main assembly 101 is provided with an opening 103 for permitting passage of the drum unit 13 so that the drum unit 13 can be inserted into and demounted from an inside of the apparatus main assembly 101. A front door 10 as an openable member movable between a closed position G (FIG. 2) where the opening 103 is closed (covered) and an open position H (FIG. 7) where the opening 103 is open (uncovered) is provided as a part of the apparatus main assembly 101.

The front door is capable of being subjected to an opening/closing (rotational) operation, relative to the apparatus main assembly 101 by the user, about a lateral shape (hinge shape) 10*a* provided in a lower edge side so as to extend in the left-right direction. That is, the front door 10 is rotated about the hinge shape 10*a* in a raising direction, so that as shown in FIG. 2, the front door 10 can be placed in a closed state relative to the apparatus main assembly 101. When the front door 10 is sufficient closed, a locking mechanism (not shown) performs a locking operation. By the locking operation, the front door 10 is prevented from opening, so that the opening 103 is stably held at the closed position G where the opening 103 is closed in a predetermined state.

Figure 7:
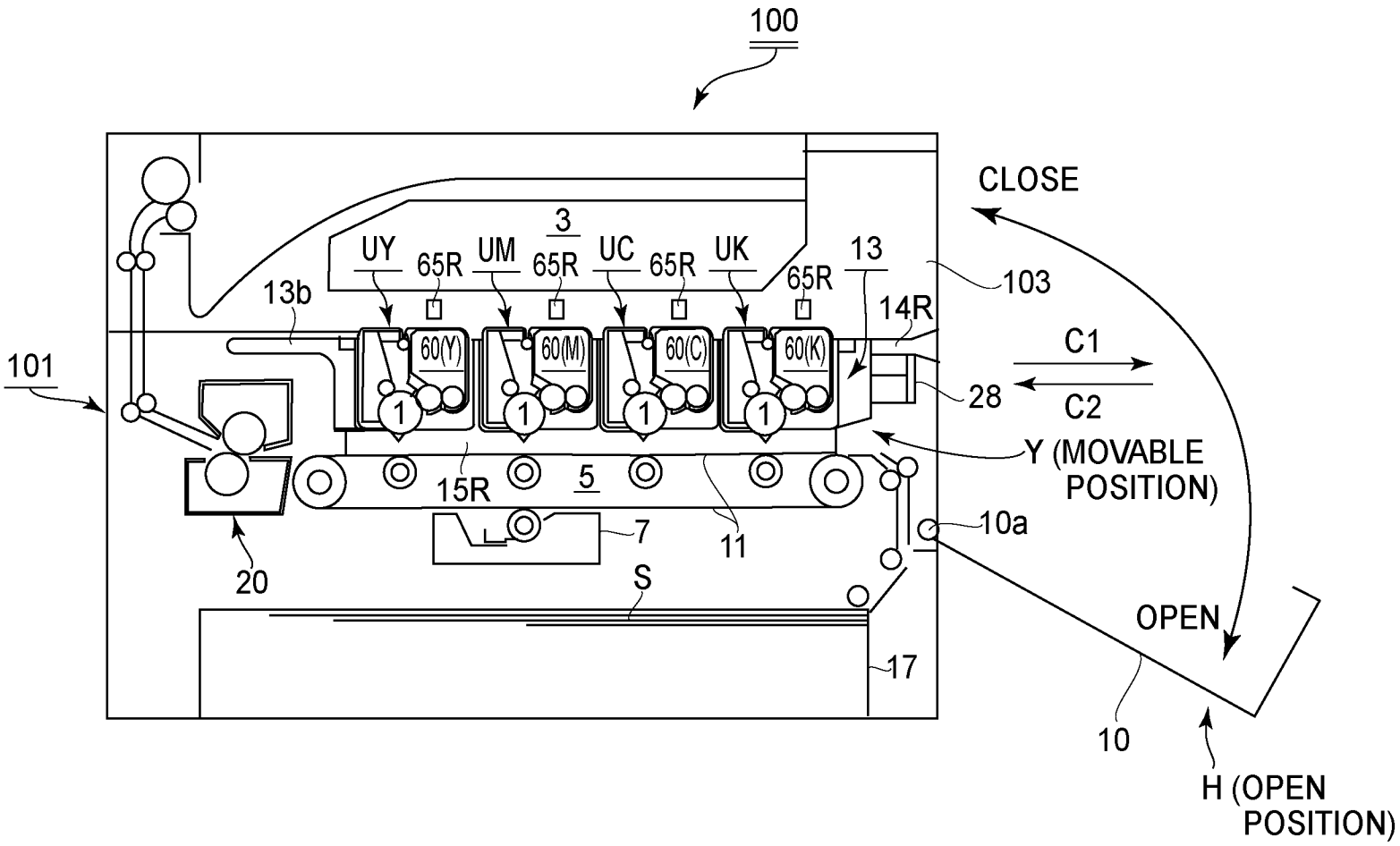
FIG. 7 is a schematic longitudinal left side view of the image forming apparatus in a state in which a door is opened and the drum unit moved from an inside position, which is an image forming position to a movable position.

Further, the front door 10 can be placed in a state in which the front door 10 is sufficiently opened to the predetermined open position H as shown in FIG. 7 by being sufficiently tilted and rotated about the hinge shape 10*a* toward the front side of the apparatus main assembly 101 through release of the locking of the locking mechanism by the user. As a result, the opening 103 is largely opened.

The drum unit 13 is movable to an inside position X where the image is formable inside the apparatus main assembly 101 as shown in FIG. 2. Further, the drum unit 13 is movable to a movable position Y where in the inside of the apparatus main assembly 101, the drum unit 13 is moved from the inside position X and thus positioning fixing of the drum 1 in the inside position X is released (eliminated). Further, the drum unit 13 passes through the open 20 from the movable position Y shown in FIG. 7 and then is movable to an outside position Z where the drum unit 13 is pulled out to the outside of the apparatus main assembly 101 and the first to fourth image forming stations UK, UC, UM and UY can be exposed to the outside as shown in FIG. 8.

Figure 8:
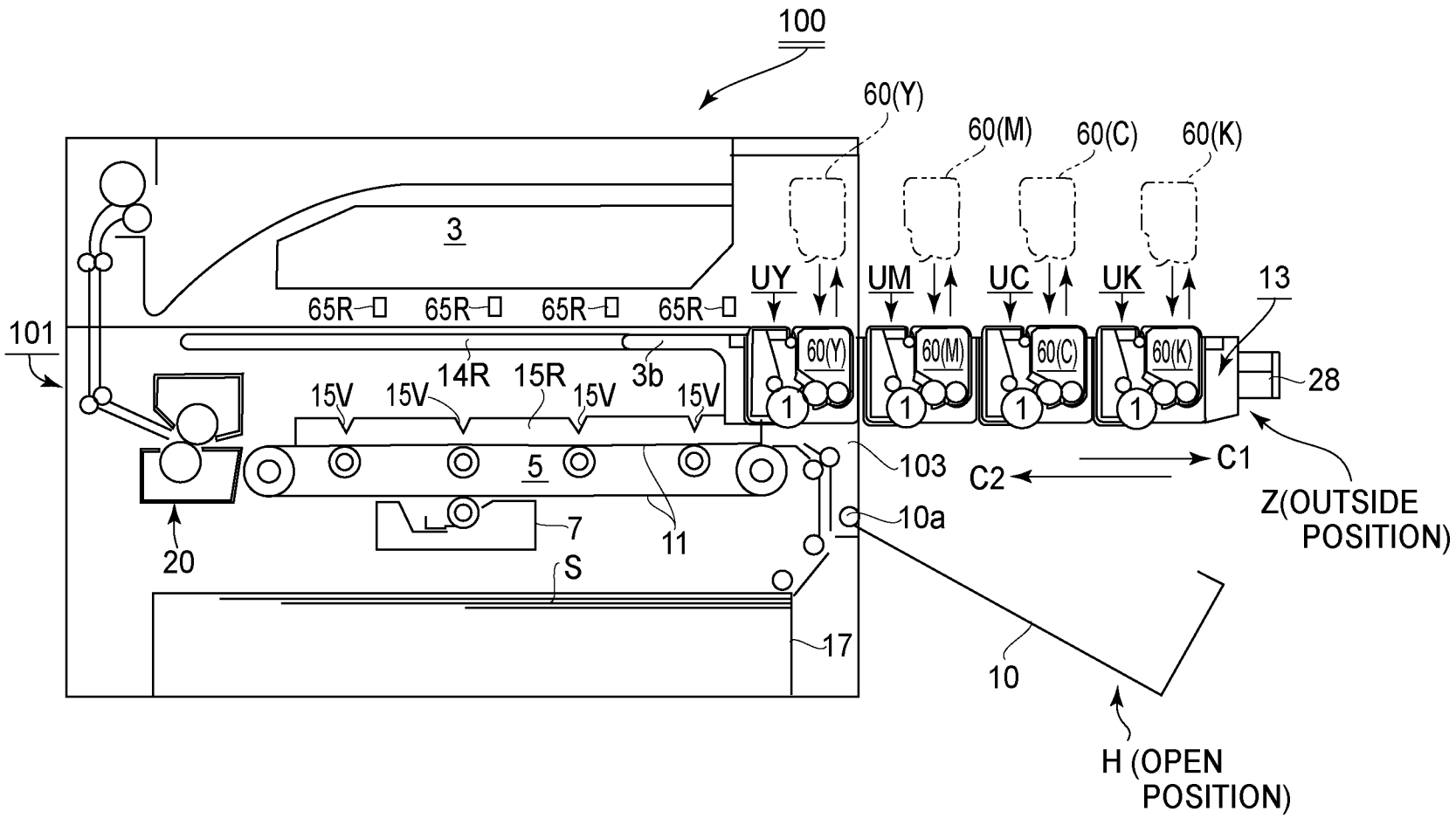
FIG. 8 is a schematic longitudinal left side view of the image forming apparatus in a state in which the drum unit is pulled out and moved from the movable position to an outside position.

When the drum unit 13 is in the outside position Z as shown in FIG. 8, the developing cartridges 60 of the image forming stations UK, UC, UM and UY are in a state in which the developing cartridges 60 are detachably mountable to the mounting portions 13*f* of the drum unit 13. That is, when the drum unit 13 is in the outside position Z, the user can demount the developing cartridge 60 from the drum unit 13 and then can mount a new developing cartridge 60 (another developing cartridge) in the drum unit 13.

(3) In this embodiment, the drum unit 13 is slidably (movably) supported relative to the apparatus main assembly 101 by the guiding portions 14L and 14R (FIG. 9) in the apparatus main assembly 101 side and the pin shapes 13*a* and the projected portions 13*b* which are members-to-be-guided in the drum unit 13 side. That is, the drum unit 13 is slidably movable (linearly pushable/pullable) substantially horizontally along the guiding portions 14L and 14R. In the following, this will be specifically described.

Parts (a) and (b) of FIG. 9 are schematic perspective views showing a drum unit movable position in the apparatus main assembly 101. In parts (a) and (b) of FIG. 9, for easy understanding of a structure of the movable position, of members (parts) constituting the apparatus main assembly 101, the discharge portion (discharge tray) 24, the scanner 3 and the like are omitted from illustration. In FIG. 9, part (a) is the schematic perspective view of the apparatus main assembly 101 in which a left side (driving side) of the movable position is in sight, and part (b) is the schematic perspective view of the apparatus main assembly 101 in which a right side (non-driving side) of the movable position is in sight.

The apparatus main assembly 101 is provided with a pair of substantially horizontal guiding portions 14L and 14R extending in the front-rear direction while an inner wall surface of a left-side frame 101L and an inner wall surface of a right-side frame 101R of an apparatus main assembly frame oppose each other. Each of the guiding portions 14L and 14R is a groove-shaped rail member having a U-shape in cross-section.

The drum unit 13 is disposed between the left and right side frames 101L and 101R so that the projected portions 13*b* and the pin shafts of the left and right frame plates 13L and 13R are engaged with guiding groove portions of the left and right guiding portions 14L and 14R, respectively. As a result, the drum unit 13 is substantially horizontally held slidably (movably) in the front-rear directions C1 and C2 between the left and right frames 101L and 101R.

The left and right guiding portions 14L and 14R are translated in synchronism with each other in an up-down (vertical) direction between a predetermined raised position and a predetermined lowered position by an interrelating mechanism (not shown) interrelated with an opening/closing operation of the front door 10. With this upward and downward translation of the guiding portions 14L and 14R, also the drum unit 13 held by the guiding portions 14L and 14R is translated in the up-down direction.

(4) As shown in FIG. 2, in a state in which the front door 10 is closed to the apparatus main assembly 101, the guiding portions 14L and 14R are in the predetermined lowered position. As a result, the drum unit 13 held by the guiding portions 14L and 14R is in the inside position X, which is the image forming position, at the mounting portion in the inside of the apparatus main assembly 101.

The drum unit 13 is prevented in this inside position X from moving in the front-rear directions C1 and C2 along the guiding portions 14L and 14R by a locking mechanism (not shown). The left and right shaft portions 47L and 47R of the drums 1 of the image forming stations UK, UC, UM and UY are abutted against and positioned to positioning portions of the left and right positioning members 15L and 15R, respectively, in the apparatus main assembly 101 side via the bearing members 31. A positioning constitution of the drums 1 will be described later.

Upper surface portions of the left and right end portions of the developing cartridges 60 of the image forming stations UK, UC, UM and UY are urged by an urging operation of urging members 65L and 65R (FIG. 9) in the apparatus main assembly 101 side, and thus are positionally fixed to the frame 130 of the drum unit 13. The urging members 65L and 65R are provided opposed to each other at inner wall surfaces of the left and right side frames 101L and 101R, respectively, of the apparatus main assembly frame. A positional constitution of the developing cartridges 60 will be also described later.

On the inner wall surface of the left-side frame 101L in the driving side of the apparatus main assembly 101, drum coupling members 25 to be coupled to the coupling members 48 provided at end portions of the left-side shaft portions 47L in the driving side of the drums 1 of the image forming stations UK, UC, UM and UY are provided. Similarly, on the inner wall surface of the left-side frame 101L, developing coupling members 26 to be coupled to the coupling members 45 (FIG. 5) provided at left-side surface portions in the driving side of the developing cartridges 60 of the image forming stations UK, UC, UM and UY are provided.

The drum coupling members 25 are members for transmitting a driving force (drive) from a driving source (not shown) in the apparatus main assembly 101 side to the drums 1. The developing coupling members 26 are members for transmitting a driving force (drive) from the driving source (not shown) in the apparatus main assembly 101 side to the developing cartridges 60. These coupling members 25 and 26 are moved in synchronism with each other between a retracted position where these coupling members 25 and 26 are spaced from the corresponding couplings 48 and 45 of the drums 1 and the developing cartridges 60 and an engaging position where the coupling members 25 and 26 are engaged with the coupling 48 and 45, by the interrelating mechanism (not shown) interrelated with the opening/closing operation of the front door 10.

In the state in which the front door 10 is closed to the apparatus main assembly 101, the drum coupling members 25 are coupled to the corresponding coupling members 48 of the drums 1 by being moved to the engaging position. Further, the developing coupling members 26 enter the developing cartridge movable positions 13*f* of the frame 130 through the openings 13*n* provided in the left frame plate 13L of the frame 130 and move to the engaging position. As a result, the developing coupling members 26 are coupled to the corresponding coupling members 45 (FIG. 5) of the developing cartridges 60 mounted in the mounting portions 13*f*.

Further, electrical contacts (not shown) in the apparatus main assembly 101 side and electrical contacts (not shown) in the drum unit 13 side electrically contact each other, so that predetermined biases (charging bias, developing bias and the like) are applicable from the voltage (power) source portion in the apparatus main assembly side to the drum unit 13 side.

The apparatus 100 is capable of performing an image forming operation in a state in which the front door 10 is closed and the drum unit 13 in which the developing cartridges 60 are mounted is in the inside position X which is the image forming position as shown in FIG. 2.

(5) From the state of FIG. 2, locking of the front door 10 is released by the user, so that the front door 10 is moved from the closed position G to the open position H (FIG. 7) and thus the opening 103 is largely opened (exposed).

In an initial stage of this rotation of the front door 10, by the operation of the interrelating mechanism, the drum coupling members 25 and the developing coupling members 26 are moved to the retracted position where the coupling members 25 and 26 are spaced from the corresponding coupling members 48 and 45, respectively, of the drums 1 and the developing cartridges 60. Similarly, by the operation of the interrelating mechanism, the urging members 65L and 65 are retracted, so that the positional fixing of the drum unit 13 of the developing units (developing cartridges) 60 to the frame 130 of the drum unit 13 is released.

Further, similarly, by the operation of the interrelating mechanism, a releasing operation of the locking mechanism is performed, so that the prevention of the movement of the drum unit 13 in the front-rear directions C1 and C2 along the guiding portions 14L and 14R is released (eliminated).

In a further opening rotation operation of the front door 10, by the operation of the interrelating mechanism, the left and right guiding portions 14L and 14R are translated from the lowered position to the raised position. As a result, the drum unit 13 is parallely raised and moved from the inside position X of FIG. 2 to the movable position Y of FIG. 7. By this raising movement of the drum unit 13, the shaft portions of the drums 1 of the image forming stations UK, UC, UM and UY are raised and spaced from the drum positioning members 15L and 15R in the apparatus main assembly 101 side in a predetermined manner. In addition, the drums 1 are raised and spaced from the belt 11 in a predetermined manner.

(6) In the state of FIG. 7 described above, the drum unit 13 is passed through the opening 103 and is pulled to the outside of the apparatus main assembly 101 and thus can be moved to the outside position Z where the upper surface sides of the image forming stations UK, UC, UM and UY are capable of being exposed as shown in FIG. 8.

That is, in the state of FIG. 7, the grip portion 28 of the drum unit 13 is exposed to the outside through the opening 13. The user grips the grip portion 28 and slides the pin shafts 13*a* and the projected portions 13*b*, which are the members-to-be-guided, of the drum unit 13 along the guiding portions 14L and 14R substantially horizontally in the frontward direction C1, and thus pulls out the drum unit 13. The drums 1 are raised and spaced from the belt in the predetermined manner, and therefore, friction between the belt 11 and the drums 1 does not generate in a process of the above-described pulling-out movement of the drum unit 13.

The drum unit 13 is sufficiently pulled-out to the predetermined outside position Z of the apparatus main assembly 101 through the opening 103 as shown in FIG. 8. As a result, an entirety of the four image forming stations UK, UC, UM and UY provided along the front-rear direction of the drum unit 13 passes through the opening 103 and is exposed to the outside of the apparatus main assembly 101, so that the user gets access to the respective developing cartridges 60.

During the pulling-out movement of the drum unit 13, the pin shafts 13*a* which are first members-to-be-guided in the front side of the frame 130, get out of the guiding portions 14L and 14R. However, the elongated projected portions 13*b* which are second members-to-be-guided in the rear side of the frame 130 and which extend in the front-rear direction, engage with the guiding portions 14L and 14R, and therefore, the drum unit 13 is substantially pulled out while being stably held in the substantially horizontal state.

Then, when the drum unit 13 is pulled out to the predetermined outside position Z, the drum unit 13 is prevented from further moving in the front-rear direction, by a stopper member (not shown). Also in this state, the projected portions 13*b* extending in the front-rear direction engage with the guiding portions 14L and 14R, and therefore, the drum unit 13 is stably held in the substantially horizontal state.

The frame 130 of the drum unit 13 supports the individual developing cartridges 60 so as to be demounted toward right (just) above. Further, the individual developing cartridges 60 are supported by the drum unit 13 by being moved toward right below. Then, the user raises and demounts the developing cartridge 60, which is used up and which should be exchanged, from the developing cartridge mounting portion 13*f* as indicated by a chain double-dashed line in FIG. 8. Then, the user engages and accommodates a new developing cartridge 60 in the mounting portion 13*f* from above.

That is, each of the developing cartridges 60 is moved and mounted in the drum unit 13 substantially in the direction of gravitation by the user. The thus mounted developing cartridge 60 is disposed so that its longitudinal direction (axial direction of the developing roller 40 is a direction perpendicular to the movement direction (C1 or C2 direction) of the drum unit 13. Incidentally, the four developing cartridges 60 are disposed and arranged in the movement direction of the drum unit 13.

Thus, according to the image forming apparatus 100 of this embodiment, the four developing cartridges 60 can be mounted altogether in the apparatus main assembly and can be pulled out altogether to the outside of the apparatus main assembly. Accordingly, compared with the case employing a constitution in which the developing cartridges 60 are individually mounted in the apparatus main assembly, this embodiment is excellent in operativity during the exchange of the developing cartridge 60.

(7) After the developing cartridge 60 is exchanged with the new developing cartridge 60, the drum unit 13 is pushed back into the inside of the apparatus main assembly 101 by being moved in the rearward direction C2. That is, the drum unit 13 is returned and moved to the predetermined movable position Y in the apparatus main assembly 101 as shown in FIG. 7. Also in this returning movement process, the drums 1 are raised and spaced from the belt 11 in the predetermined manner, and therefore, the friction between the belt 11 and the drums 1 does not generate. During the returning movement of the drum unit 13, the pin shafts 13*a* engage with the guiding portions 14L and 14R.

After the user returns and moves the drum unit 13 to the movable position Y, the user closes the front door 10 to the apparatus main assembly 101 and thus closes the opening 103. When the front door 10 is sufficiently closed, the front door 10 is prevented from opening and thus is stably held in the closed position G.

In this closing rotation operation of the front door 10, by the operation of the interrelating mechanism, the left and right guiding portions 14L and 14R are translated from the raised position to the lowered position. As a result, the drum unit 13 is parallely lowered and moved from the movable position Y of FIG. 7 to the inside position X, which is the image forming position, of FIG. 2.

By this lowering movement of the drum unit 13, the left and right shaft portions 47L and 47R abut against the positioning portions of the left and right drum positioning portions 15L and 15R, respectively, in the apparatus main assembly 101 side via the bearing members 31. As a result, the drums 1 are positioned relative to the apparatus main assembly 101. The lower surfaces of the drums 1 is in a contact state with the electrical contacts in the apparatus main assembly 101 side. Further, the electrical contacts in the drum unit 13 side are in a contact state with the electrical contacts in the apparatus main assembly 101 side.

By the operation of the interrelating mechanism, the engaging operation of the lacking mechanism is performed, so that the movement of the drum unit 13 in the front-rear directions C1 and C2 along the guiding portions 14L and 14R is prevented. Similarly, by the operation of the interrelating mechanism, the urging operation of the urging members 65L and 65R is performed, so that the upper surface portions of the left and right end portions of the developing cartridges 60 in the image forming stations UK, UC, UM and UY are urged by the urging members 65L and 65R. As a result, the developing cartridges 60 are positionally fixed to the frame 130 of the drum unit 13.

Then, in a subsequent closing rotation operation of the front door 10, by the operation of the interrelating mechanism, the drum coupling members 25 are moved to the engaging position and are coupled to the corresponding coupling members 48 of the drums 1. Further, the developing coupling members 26 are caused to enter the developing cartridge mounting portions 13*f* of the frame 130 through the openings 13*n* of the left frame plate 13L and are moved to the engaging position, so that the developing coupling members 26 are coupled to the corresponding coupling members 45 of the developing cartridges 60 mounted in the mounting portions 13*f*. As a result, the image forming apparatus 100 is restored to the state in which the image forming apparatus 100 is capable of performing the image forming operation.

(8) In the above, the exchange of the developing cartridge 60 was described, but it is also possible to exchange the drum unit 13. In this case, the drum unit 13 is pulled out to the outside position Z as shown in FIG. 8. Then, a movement-preventing function of the stopper (not shown) preventing the further movement of the drum unit 13 is eliminated (released). As a result, the drum unit 13 can be demounted from the apparatus main assembly 101.

Then, a new drum unit 13 is mounted on the guiding portions 14L and 14R. When the developing cartridges 60 mounted in the demounted drum unit 13 are still usable, the developing cartridges 60 can be subsequently used by being mounted in the new drum unit 13.

<Mounting Constitution of Developing Cartridge>

A mounting constitution of the developing cartridges 60 in the drum unit 13 will be described with reference to FIGS. 2 to 5. The developing cartridges 60 of the image forming stations UK, UC, UM and UY have the same cartridge constitution and the same mounting constitution except that only the colors of the toners accommodated therein are different from each other, and therefore, the mounting of the developing cartridge 60 of the first image forming station UK will be described as a representative example. As described above, when the developing cartridge 60 is mounted, the mounting operation is performed in the state (FIG. 8) in which the drum unit 13 is pulled out from the inside of the apparatus main assembly 101 to the outside position Z, but in FIGS. 2 to 5, the apparatus main assembly 101 is omitted from illustration.

The developing cartridges 60 are mounted in the mounting portions 13*f* provided in the drum unit 13 at the image forming stations UK, UC, UM and UY. The user mounts the developing cartridges 60 substantially in the direction of gravitation.

On the longitudinal side surfaces of each of the developing cartridges 60, projections 61L and 61R (FIG. 5) are provided. These projections 61L and 61R are guided by guiding portions 13*i* and 13*r* provided on the left and right frame plates 13L and 13R, respectively. Further, as outer peripheral surface of the coupling member 45 provided on the left side surface in the driving side of the developing cartridge 60 is covered with a cylindrical rib 62. This cylindrical rib 62 functions as a portion-to-be-guided to be guided by a guiding portion 13*g*L provided on the inner wall surface of the left frame plate 13L of the drum unit 13 so as to extend in the up-down direction.

Further, also on the right side surface in the non-driving side of the developing cartridge 60, a portion-to-be-guided (not shown) to be guided by a guiding portion 13*g*R provided on the inner wall surface of the right frame plate 13R of the drum unit 13 so as to extend in the up-down direction is provided coaxially with the above-described cylindrical rib 62.

In the case where the developing cartridge 60 is mounted, first, the portions-to-be-guided (cylindrical rib 62 and corresponding unshown portion) provided on the longitudinal side surfaces of the developing cartridge 60 are mounted so as to be engaged with the pair of guiding portions 13*g*L and 13*g*R. Then, the projections 61L and 61R provided on the side surfaces of the developing cartridge 60 are mounted so as to be engaged with the pair of guiding portions 13*i* and 13*r* provided on the drum unit 13. Thus, the developing cartridge 13 is mounted in the mounting portion 13*f* of the drum unit 13.

Then, as described above, in the state in which the drum unit 13 is in the inside position X as shown in FIG. 2, the upper surface portions of the left and right end portions of the developing cartridge 60 mounted in each of the mounting portions 13*f* are urged by the urging members 65L and 65R. As a result, the developing cartridge 60 is positionally fixed to the frame 130 of the drum unit 13.

<Drum Supporting Structure>

A supporting structure of the drums 1 in the drum unit 13 will be described. The cylindrical bearing members 31 are externally fitted around the left and right shaft portions (rotation center shaft portions) 47L and 47R in the driving side and the non-driving side of the drums 1 of the image forming stations UK, UC, UM and UY in the drum unit 13.

That is, each drum 1 includes a left-side shaft portion (one end side shaft portion) 47L and a right-side shaft portion (the other end side shaft portion) 47R which are coaxial with a rotational axis of the drum 1, and the bearing members 31 are mounted on the shaft portions 47L and 47R, respectively. The bearing members 31 pass through openings 13*m* as supporting portions formed in the left and right frame plates 13L and 13R of the frame 130 of the drum unit 13 and extend to the outsides of the left and right frame plates 13L and 13R as shown in FIG. 3A and FIG. 3B, respectively.

Part (a) of FIG. 10 is an exploded schematic perspective view of the shaft portion 47L and the bearing member 31 to be externally fitted around the shaft portion 47L in the left side which is the driving side of the drum 1, and is a schematic perspective view showing a state in which the bearing member 31 is externally fitted around (engaged with) the shaft portion 47L. At an end portion of the shaft portion 47L in the left side as the driving side, the coupling member 48 to be engaged with the drum coupling member 25 provided in the apparatus main assembly side is provided and is exposed from the end portion of the bearing member 31.

Part (b) of FIG. 10 is an exploded schematic perspective view of the shaft portion 47R and the bearing member 31 to be externally fitted around the shaft portion 47R in the right side which is the non-driving side of the drum 1, and is a schematic perspective view showing a state in which the bearing member 31 is externally fitted around (engaged with) the shaft portion 47R.

The bearing members 31 to be externally fitted around the left and right shaft portions 47L and 47R, respectively, are members having the same shape and are engaged with the left and right shaft portions 47L and 47R in a bilaterally symmetrical manner. Thus, the reason why the cylindrical bearing members 31 are externally fitted around the shaft portions 47L and 47R of the drum 1 is that the shaft portions 47L and 47R and the drum positioning members 15L and 15R for positioning and holding (supporting) the shaft portions 47L and 47R in the apparatus main assembly 101 side are prevented from directly sliding with each other.

Although details will be described later, through these left and right bearing members 31, the drum 1 is positioned at a temporary positioning position, which is a first position, where the drum unit 13 is temporarily positioned relative to the frame 130, and is positioned at a position, which is a second position, where the drum 1 is positioned relative to the drum positioning members 15L and 15R.

Then, an operation in which the drums 1 supported in the drum unit 13 are positioned relative to the apparatus main assembly 101 in the inside position X of the apparatus main assembly 101 will be described with reference to FIGS. 11 to 13.

FIG. 11 is a schematic perspective view showing a positional relationship between the drum unit 13 and the left and right drum positioning members 15L and 15R in the apparatus main assembly 101 side as seen from the driving side. FIG. 11 shows a state in which the drum unit 13 is in the movable position Y (FIG. 7) and the bearing members 31 of the left and right shaft portions 47L and 47R of the drums 1 in the image forming stations UK, UC, UM and UY are spaced from the drum positioning members 15L and 15R. FIG. 12 is a schematic perspective view showing the state of FIG. 11 as seen from the non-driving side.

FIG. 13 shows a state in which the drum unit 13 is moved from the movable position Y (FIG. 7) to the inside position X (FIG. 2) which is the image forming position and thus the bearing members 31 of the left and right shaft portions 47L and 47R of the drums 1 are received by the drum positioning members 15L and 15R in a predetermined manner. That is, the drums 1 are in a positionally fixed state to the apparatus main assembly 101 in a predetermined manner.

In FIGS. 11 to 13, for easy understanding of a positioning operation, parts other than the drum positioning members 15L and 15R in the apparatus main assembly 101 side and the drum unit 13 including the developing units (developing cartridges) 60 are omitted from illustration.

As described above, the movement of the drum unit 13 from the movable position Y to the inside position X as the image forming position is carried out by the interrelating mechanism interrelated with the closing rotation operation of the front door 10. In this embodiment, as the drum positioning members 15L and 15R, metal plates are used and are integrally mounted to the apparatus main assembly 101.

The positioning operation of the drums 1 will be further described specifically. In a state in which the drum unit 13 is in the movable position Y or the outside position Z, the drums 1 of the image forming stations UK, UC, UM and UY are temporarily positioned relative to the unit frame 130 through the left and right bearing members 31 at the first position in a state with play. This will be described with reference to FIG. 1 by using the bearing member 31, externally fitted around the left-side shaft portion 47L in the driving side, as a representative example. Also as regards the bearing member 31 externally fitted around the right-side shaft portion 47R in the non-driving side, the positioning operation is similar to that in the case of the bearing member 31 in the driving side shown in FIG. 1.

Figure 1:
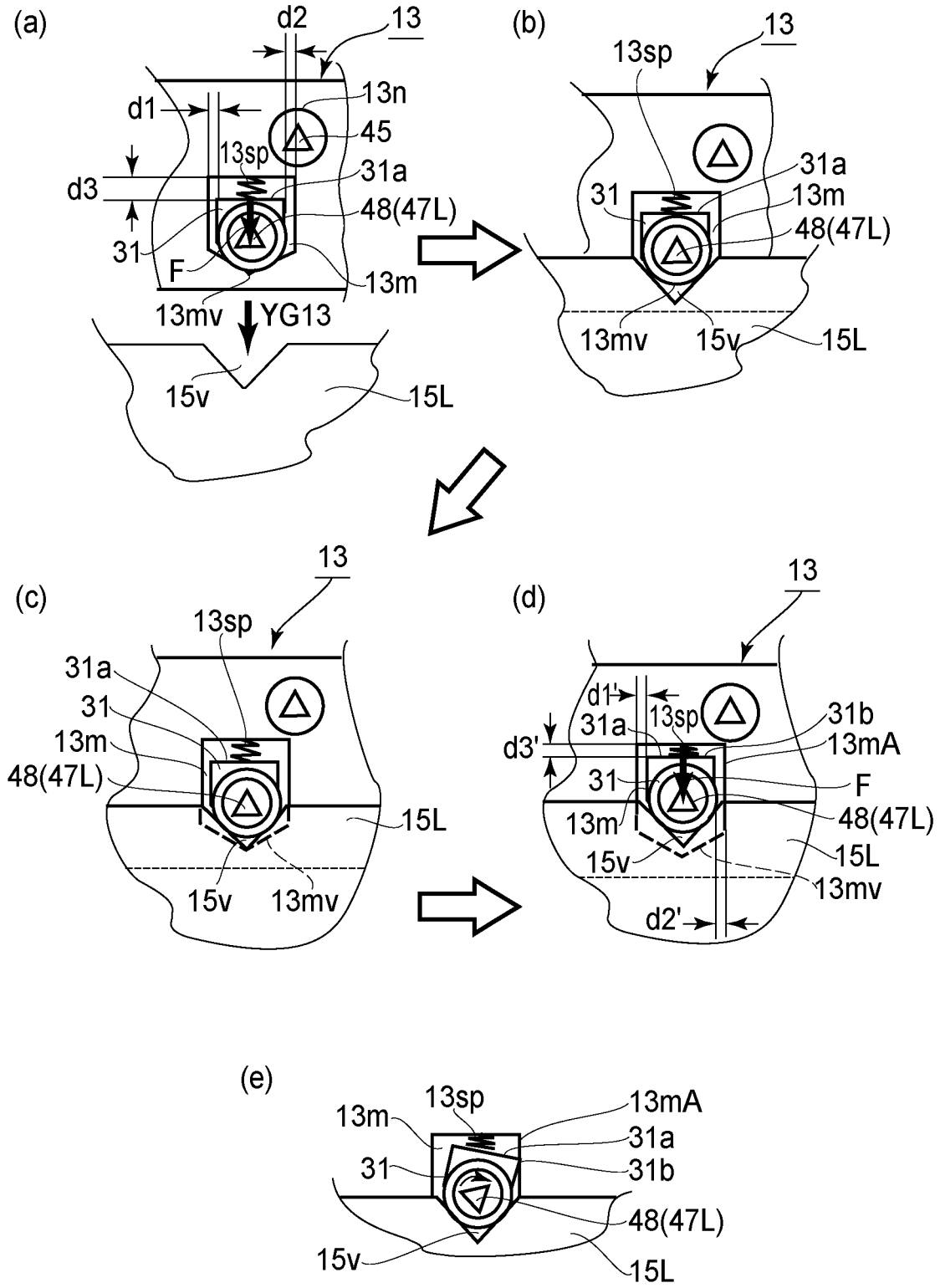

As shown in part (a) of FIG. 1, between the opening 13*m* and the bearing member 31 coaxial with the drum 1, gaps (spacing)s d1, d2 and d3 are provided. As the bearing member 31, a polyacetal (polyoxymethylene, POM) resin material having a sliding property is used, but a member prepared by applying grease onto another resin material or a metal member may also be used. The opening 13*m* is provided with a V-shaped portion 13*mv* as a temporary positioning portion.

When the drum unit 13 is in the movable position Y or the outside position Z or when the drum unit 13 is demounted from the apparatus main assembly 101 (i.e., during non-mounting of the drum unit 13), the bearing member 31 externally fitted around the shaft portion 47L of the drum 1 is received and supported by the V-shaped portion 13*mv*. That is, the drum 1 is supported in the first position which is the temporary positioning position.

At this time, in order to move and urge the bearing member 31 against the V-shaped portion 13*mv*, an urging member 13*sp* is provided in the gap d3 positioned above the V-shaped portion 13*mv*. That is, by an urging force F of the urging member 13*sp*, an upper surface of the bearing member 31*a* of the bearing member 31 is urged, so that the bearing member 31 is urged in a direction of the V-shaped portion 13*mv*.

The V-shaped portion 13*mv* may only be required to roughly determine the position of the drum 1 in the drum unit 13 during the non-mounting of the drum unit 13 and is not required to position the drum 1 with high accuracy. For that reason, there is no need to perform adjusting assembling, so that a cost can be suppressed.

An operation in which the drum 1 is positioned relative to the drum positioning member 15L (15R) will be described in order with reference to parts (a) to (e) of FIG. 1. The drum unit 13 positioned at the movable position Y in the apparatus main assembly 101 is, as described above, constituted so as to be lowered together with the guiding portions 14L and 14R in interrelation with the closing operation of the front door 10 (YG 13 direction of part (a) of FIG. 1).

When the drum unit 13 is lowered in the YG 14 direction to same extent, as shown in part (b) of FIG. 1, the bearing member 31 starts to engage with a V-shaped portion 15*v* provided on the drum positioning portion 15L (15R) provided integrally with the apparatus main assembly 101.

When the drum unit 13 is further lowered, as shown in part (c) of FIG. 1, the bearing member 31 is released from the V-shaped portion 13*mv* which is the temporary positioning portion. Then, the drum unit 13 is continuously lowered further, and is finally lowered to and stopped at a predetermined position as shown in part (d) of FIG. 1.

In this state, all of the drums 1 are urged against the V-shaped portions 15*v* of the drum positioning members 15L (15R). As a result, all of the drums 1 are directly positioned relative to the apparatus main assembly at the second position with respect to the drum positioning members 15L (15R) provided in the apparatus main assembly 101 side. For that reason, the drums 1 are positioned relative to the apparatus main assembly 101 with high accuracy.

All of the bearing members 31 are always urged against the V-shaped portions 15*v* of the drum positioning members 15L (15R) by the urging members 13*sp* provided integrally with the drum unit 13, and thus can maintain a stable position also during the image forming operation.

Further, as regards the gaps d1 to d3, as shown in part (d) of FIG. 1, in the predetermined mounting position (inside position X as the image forming position) where the drums 1 are set in the apparatus main assembly 101, corresponding gaps (spacings) d1', d2' and d3' are set so as to satisfy: d1'>0, d2'>0, d3'>0. In this embodiment, the gaps d1', d2' and d3' are set at about 0.05 mm as a necessary minimum value.

An advantage of provision of the gaps d1 and d2 is as follows. The bearing member 31 of the drum unit 13 in the movable position Y is pushed in a proper position of the V-shaped portion 15*v* even when the bearing member 31 and the V-shaped portion 15*v* of the drum positioning member 15L (15R) are somewhat deviated from each other. Then, when the driving force is transmitted to the coupling member 48 provided at the end portion of the left-side shaft portion 47L in the driving side, as shown in part (e) of FIG. 1, a corner portion 31*b* of the bearing member 31 abuts against a surface 13*m*A of the opening 13*m*, so that rotation of the bearing member 31 is prevented.

As the reasons for providing the urging member 13*sp*, there are advantages such that (1) the position of the drum 1 is regulated during transportation (distribution) of the drum unit 13 alone and thus friction of the drum 1 with the charging roller 2 is prevented, and (2) the position of the drum 1 is stabilized during the image forming operation, and the like.

A principal constitution of the photosensitive member unit (drum unit) 13 in this embodiment (Embodiment 1) is summarized as follows. At least the photosensitive drum 1 and the frame 130 supporting the photosensitive drum 1 which are detachably mountable to the predetermined image forming position (inside position) X in the apparatus main assembly 101 of the electrophotographic image forming apparatus 101 are provided. The photosensitive drum 1 includes one end shaft portion 47L and the other end shaft portion 47R which are coaxial with the rotational axis thereof. The frame 130 includes the supporting portions 13*m* capable of roughly supporting the one end shaft portion 47L and the other end shaft portion 47R.

Further, when the photosensitive member unit 13 is not mounted in the image forming position X of the apparatus main assembly 101, the one end shaft portion 47L and the other end shaft portion 47R are in the first position where the shaft portions 47L and 47R are positioned to the first positioning portions 13*m*V of the supporting portions 13*m*, respectively.

Further, when the photosensitive member unit 13 is mounted in the image forming position X, the one end shaft portion 47L and the other end shaft portion 47R of each of all of the photosensitive drums 1 are in the second position where the shaft portions 47L and 47R are positioned to the second positioning portions 15*v* of the positioning members 15L and 15R, respectively, which are provided integrally with the apparatus main assembly 101.

On the one end shaft portion 47L and the other end shaft portion 47R, the bearing members 31 are mounted (externally fitted). The urging members 13*sp* for moving and urging the one end shaft portion 47L and the other end shaft portion 47R toward the first positioning portions 13*mv* are provided. The developing means 60 for developing, with the toner T, the latent image formed on the photosensitive drum 1 is provided. On the side surface of the developing means 60, the coupling member 48 for receiving the driving force from the apparatus main assembly 101 side is provided.

In this embodiment, the drum unit 13 to which the developing cartridge 60 was detachably mountable was described as an example, but as another embodiment, a constitution in which each of the developing cartridge 60 and the drum unit 13 is separately detachably mountable to the apparatus main assembly 101 may also be employed.

In this embodiment, a constitution in which the drum unit 13 supported the plurality of drums 1 was described as an example, but as another embodiment, a drum unit constitution in which a single drum 1 is supported may also be employed.

<Excellent Points of this Embodiment>

Excellent points of the present invention will be described below with reference to part (a) of FIG. 14 which is a schematic view of a drum unit 213 in a comparison example and part (b) of FIG. 14 which is a schematic view of the drum unit 13 in this embodiment according to the present invention. Part (a) of FIG. 14 is the schematic view of a constitution including the drum unit 213 and drum unit positioning members 215L and 215R in the comparison example as seen from above. Part (b) of FIG. 14 is the schematic view of a constitution including the drum unit 13 and the drum positioning members 15L and 15R as seen from above.

In the comparison example shown in part (a) of FIG. 14, the drum unit 213 accommodating a plurality of drums 201 is positioned relative to the main assembly-side positioning portions 215L and 215R, provided integrally with an apparatus main assembly, by drum unit positioning members 314 and 316. At an end portion of a shaft portion 247L each of the drums 201 in the driving side, a coupling member 248 is provided.

That is, parts until the positions of the drums 201 are determined relative to the main assembly-side positioning members 215L and 215R of the image forming apparatus are schematically described as follows. The drums 201 are positioned relative to the apparatus main assembly in the order of: the positioning members 215L and 215R, the drum unit positioning members 314 and 316, the drum positioning members 315L and 315R, bearing members 231, the coupling members 248, and the drums 201.

For that reason, in order to accurately position the drums 201 relative to the main assembly-side positioning members 215L and 215R in the apparatus main assembly, there is a need to accurately position the drums 201 relative to the drum unit positioning members 314 and 316. For that reason, there is a need to strictly control part accuracy during manufacturing, so that in some cases, countermeasures such as execution of adjusting assembling were taken.

On the other hand, parts until the positions of the drums 1 are determined relative to the apparatus main assembly in the embodiment of the present invention shown in part (b) of FIG. 14 are schematically described as follows. The drums 1 are positioned relative to the apparatus main assembly in the order of: the main assembly-side positioning members 15L and 15R, the bearing members 31, the coupling members 48, and the drums 1, so that the number of the parts is smaller than that in the constitution of the comparison example shown in part (a) of FIG. 14. For that reason, a positional fluctuation of the drums due to a variation in part tolerance can be suppressed, so that there is no need to realize adjusting assembling with high accuracy and high-precision parts.

That is, with a simple constitution, the positions of the drums 1 relative to the scanner unit 3 are determined with high accuracy, and therefore, color misregistration does not readily generate. Further, as shown in part (b) of FIG. 14, there is no need to provide the drum positioning members 315L and 315R in the drum unit as shown in part (a) of FIG. 14, so that a width of the apparatus main assembly with respect to the longitudinal direction (direction parallel to the drum axis) can be shortened. Thus, it is possible to realize downsizing of the apparatus main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-216985 filed on Nov. 7, 2016, which is hereby incorporated by reference herein in its entirety.

What is claimed is:

1. A photosensitive member unit detachably mountable to a main assembly of an electrophotographic image forming apparatus, said photosensitive member unit comprising:

a plurality of photosensitive drums having respective rotational axes and each including one and the other end shaft portions coaxial with the respective rotational axes;

a frame to which each of said plurality of photosensitive drums is attached, and including a plurality of supporting portions configured to support said one and the other shaft portions, wherein said one and the other end shaft portions are movable between first positions in which said one and the other end shaft portions are supported by said supporting portions and second positions in which said one end of the other end shaft portions are not supported by said supporting portions;

a plurality of mounting portions which are provided in said frame and to which developing units including developing members capable of supplying toner to said photosensitive drums are mountable, and from which the developing units are dismountable without dismounting said photosensitive drums from said frame, in a state that said one and the other end shaft portions are supported by said supporting portions; and a plurality of urging members configured to urge said one and the other end shaft portions toward the first positions and the second positions.

2. An electrophotographic image forming apparatus comprising:

a main assembly;

a photosensitive member unit detachably mountable to said main assembly of said electrophotographic image forming apparatus in a predetermined image forming position, wherein said photosensitive member unit includes a plurality of photosensitive drums and a frame, to which each of said plurality of photosensitive drums are attached, supporting said photosensitive drums and including mounting portions;

a plurality of developing units including developing members configured to supply toners to said photosensitive drums and including toner accommodating portions accommodating the toners to be supplied to said photosensitive drums, wherein said developing units are dismountable without dismounting said photosensitive drums from said photosensitive member unit, wherein said photosensitive drums having respective rotational axes and each including one and the other end shaft portions coaxial with the respective rotational axes, wherein said frame includes a plurality of supporting portions configured to support said one and the other end shaft portions of said photosensitive drums, wherein said main assembly includes a plurality of positioning portions configured to position said one and the other end shaft portions of said photosensitive drums, wherein said one and the other end shaft portions are in first positions in which said one and the other end shaft portions are supported by said supporting portions so that said photosensitive member unit is not in the image forming position, and wherein said one and the other end shaft portions of said photosensitive drums are in second positions in which said one and the other end portions are positioned by said positioning portions and are not supported by said supporting portions so that said photosensitive member unit is in the image forming position; and a plurality of urging members configured to urge said one and the other end shaft portions toward the first positions and the second positions.

3. A photosensitive member unit detachably mountable to a main assembly of an electrophotographic image forming apparatus, the main assembly including a moving mechanism configured to move the photosensitive member unit from a third position to a forth position, the main assembly including a positioning portion, the photosensitive member unit comprising:

a photosensitive drum;

a frame, to which photosensitive drum is attached, having a supporting portion configured to support the photosensitive drum; and an urging member configured to urge the photosensitive drum, wherein the photosensitive drum is configured to be movable, with respect to the frame, from a first position to a second position in conjunction with a movement of the photosensitive member unit from the third position to the fourth position, the first position being a position in which the photosensitive drum is supported by the supporting portion and is not positioned by the positioning portion, the second position being a position in which the photosensitive drum is positioned by the positioning portion and is not supported by the supporting portion, and wherein the urging member is configured to urge the photosensitive drum toward the supporting portion when the photosensitive member unit is in the third position, and is configured to urge the photosensitive drum toward the positioning portion when the photosensitive member unit is in the fourth position.

4. A photosensitive member unit according to claim 1, wherein said photosensitive drum is non-dismountably mounted in said frame.

5. A photosensitive member unit according to claim 1, further comprising a plurality of bearing members configured to hold said one and the other end shaft portions of said photosensitive drums, wherein said one and the other end shaft portions are positioned in the first positions by said supporting portions through said bearing members.

6. A photosensitive member unit according to claim 1, wherein said developing cartridges include developing rollers configured to supply the toners to latent images formed on said photosensitive drums.

7. A photosensitive member unit according to claim 1, wherein said one end shaft portions are provided with coupling portions which engages with a plurality of coupling members provided in the main assembly and to which driving forces are inputted.

8. A photosensitive member unit according to claim 2, wherein said photosensitive drum is non-dismountably mounted in said frame.

9. An electrophotographic image forming apparatus according to claim 2, further comprising a plurality of bearing members configured to hold said one and the other end shaft portions of said photosensitive drums, wherein said one and the other end shaft portions are supported in the first positions by said supporting portions through said bearing members so that said photosensitive member unit is not mounted in the image forming position, and wherein said one and the other end shaft portions are positioned in the second positions by said supporting portions through said bearing members so that said photosensitive member unit is mounted in the image forming position.

10. An electrophotographic image forming apparatus according to claim 2, wherein said developing cartridges include developing rollers configured to supply the toners to latent images formed on said photosensitive drums.

11. An electrophotographic image forming apparatus according to claim 2, wherein said one end shaft portions are provided with coupling portions which engages with a plurality of coupling members provided in the main assembly and to which driving forces are inputted.

12. The photosensitive member unit according to claim 3, the second position is a position farther away from the supporting portion than the first position in a direction crossing a rotational axis of the photosensitive drum.

13. The photosensitive member unit according to claim 3, further comprising:

a mounting portion provided in the frame and to which a developing unit including a developing member capable of supplying toner to the photosensitive drum is mountable, and from which the developing unit is dismountable without dismounting the photosensitive drum from the frame, in a state that the photosensitive drum is positioned by the positioning portion.

* * * * *